US006530256B1

(12) United States Patent
Irie et al.

(10) Patent No.: US 6,530,256 B1
(45) Date of Patent: Mar. 11, 2003

(54) METHOD AND DEVICE FOR EXPANDING TUBE MATERIAL

(75) Inventors: Tohru Irie, Aichi (JP); Akinobu Morikawa, Aichi (JP); Hisashi Hayakawa, Aichi (JP)

(73) Assignee: Sango Co., Ltd., Nagoya (JP)

( * ) Notice: Subject to any disclaimer, the term of this patent is extended or adjusted under 35 U.S.C. 154(b) by 0 days.

(21) Appl. No.: 09/763,208

(22) PCT Filed: Jun. 21, 2000

(86) PCT No.: PCT/JP00/04038

§ 371 (c)(1),
(2), (4) Date: Feb. 20, 2001

(87) PCT Pub. No.: WO00/78479

PCT Pub. Date: Dec. 28, 2000

(30) Foreign Application Priority Data

Jun. 21, 1999 (JP) ..... 11-173462

(51) Int. Cl.[7] ..... B21D 41/02
(52) U.S. Cl. ..... 72/370.1; 72/316; 72/358
(58) Field of Search ..... 72/343, 352, 354.6, 72/354.8, 357, 358, 359, 370.1, 370.11, 406, 316, 318, 367.1

(56) References Cited

U.S. PATENT DOCUMENTS 1,230,177 A * 9/1917 Granz ..... 72/358
2,060,690 A * 11/1936 Richard ..... 72/358
2,245,642 A * 6/1941 Bell et al. ..... 72/352

FOREIGN PATENT DOCUMENTS

| | | |
|---|---|---|
| JP | 58-185336 | 12/1983 |
| JP | 5-31547 | 2/1993 |
| JP | 2000-190030 | 11/2000 |

* cited by examiner

*Primary Examiner*—Lowell A. Larson
(74) *Attorney, Agent, or Firm*—Stevens, Davis, Miller & Mosher, LLP

(57) ABSTRACT

There are disclosed an expanded tube processing method and expanded tube processing apparatus of a cylindrical tube, for inclining an opening end portion of a work formed of the cylindrical tube of metal with respect to an axis of a work to perform tube expansion, in which in order to simply perform an expanded tube processing, a punch is disposed on an opening end side of the work of the metal cylindrical tube and the punch is inserted from the work opening end to perform the tube expansion on a work end. A punch 18 is inserted from the work opening end at a predetermined angle to a tube axis A of a work 6. During insertion of the punch 18, the punch 18 and/or the work 6 are moved in a direction $Y_1$-$Y_2$ substantially crossing at right angles to an advancing/retreating drive direction $Z_1$-$Z_2$ of the punch 18 to perform the expanded tube processing.

33 Claims, 20 Drawing Sheets

METHOD AND DEVICE FOR EXPANDING TUBE MATERIAL

TECHNICAL FIELD

The present invention relates to an expanded tube processing method and an expanded tube processing apparatus of a cylindrical tube.

RELATED ART

There has been heretofore a case in which an expanded tube portion having an axis inclined with respect to a tube axis of a cylindrical tube (tube) is formed on an end of the cylindrical tube (tube) of a metal.

For example, in an exhaust tube in automotive parts and the like, in order to secure a path in a limited space under a vehicle floor, as shown in FIG. 18, one tube 101 is connected to another tube 102 at a reduced diameter portion 103 in such a manner that a tube axis B of another tube 102 is inclined with respect to a tube axis A of the one tube 101. When such a connection is performed, for example, as shown in FIG. 19, there may be used such a connection tube that a gradually changing portion 105 is formed at a tip end of a rare tube 104 of a cylindrical tube consisted of a metal tube by expanding the tube, and an expanded tube portion 106 for connection is continuously formed at the tip end of the gradually changing portion 105, tube axes C, B of the gradually changing portion 105 and the expanded tube portion 106 are inclined with respect to the tube axis A of the rare tube 104.

Additionally, a gradually changing portion 107 may be integrally formed beforehand on a side opposite to the expanded tube portion 106 in the rare tube 104 as shown in FIG. 18.

FIGS. 20 and 21 discussed below were developed by the present inventors in the process of inventing the method and apparatus of the present invention.

Moreover, a process is considered in which a usual punch is utilized in a method of molding the gradually changing portion 105 and expanded tube portion 106 with the inclined tube axes on the tip end of the rare tube 104. Specifically, as shown in FIG. 20, considered is the process comprising: molding an enlarged diameter portion 105*a* concentric with the tube axis A of the rare tube 104 beforehand on the end of the rare tube 104; holding and fixing a work W formed of the rare tube 104 and enlarged diameter portion 105*a* with a forming die 108 in such a manner that the tube axis A slopes with respect to a vertical line B as shown in FIG. 20; simply lowering a punch 110 with an inner die surface 109 formed on a lower surface thereof only in a vertical direction to insert the punch into the enlarged diameter portion 105*a*; and using the inner die surface 109 and an outer die surface 111 of the forming die 108 to press-mold the enlarged diameter portion 105*a* on the gradually changing portion 105 and expanded tube portion 106 inclined with respect to the tube axis A.

However, according to this process, as shown in FIG. 21, the inner die surface 109 of the punch 110 is provided with a portion 109*a* which interferes with an opening end surface 105*b* of the enlarged diameter portion 105*a*, and the enlarged diameter portion 105*a* collapses and causes a problem that an expanded tube processing is not established.

In order to prevent the aforementioned interference, it is also proposed to utilize a known slant cutting die as shown in FIG. 22. This process comprises the steps of: forming a slant hole 202 in a punch guide 201; disposing a punch 203 in the slant hole 202 in a slidable manner and also disposing a return spring 204; striking a head of the punch 203 with a cam block 205 to move the punch 203 in a slant downward direction; and piercing an inclinedly disposed work 206.

When this process is applied to an enlarged diameter processing of the gradually changing portion 105 and expanded tube portion 106, no interference problem described with reference to FIG. 21 occurs. However, the large punch guide 201 is necessary and this is uneconomical. Furthermore, every time differences in a tube axis angle and an expanded tube shape between the gradually changing portion 105 and the expanded tube portion 106 are handled, a new punch guide 201 needs to be provided, which causes a problem that installation expenses also increase.

If the aforementioned conventional apparatus is utilized to form the gradually changing portion and expanded tube portion inclined with respect to the tube axis of the rare tube, the aforementioned respective problems occur. There have been demanded an expanded tube processing method and apparatus which can subject the inclined gradually changing portion and expanded tube portion to the expanded tube processing with a simple constitution.

DISCLOSURE OF THE INVENTION

Wherefore, an object of the present invention is to provide an expanded tube processing method and an expanded tube processing apparatus in which an expanded tube portion provided with a tube axis having an angle with respect to a tube axis of a rare tube can be processed with good precision.

In order to solve the aforementioned problems, according to a first aspect of the present invention, there is provided an expanded tube processing method of a cylindrical tube in which a punch is disposed on the side of an opening end of a work formed of a metal cylindrical tube and the punch is inserted from the opening end of the work to enlarge the diameter of an end of the work, the method comprising steps of: inserting the punch from the opening end of the work at a predetermined angle with respect to a tube axis of the work; and moving the punch and/or the work during insertion of the punch in a direction substantially crossing at right angles to a punch insertion path to perform an expanded tube processing.

In the expanded tube processing method according to the present invention, a work opening end surface on the side of insertion of the punch may also be formed to be substantially at right angles to the insertion path of the punch.

Moreover, in the expanded tube processing method according to the present invention, the work may be inclined and held with respect to the vertical direction, the insertion path of the punch is vertical, and movement of the punch and/or the work in the direction substantially crossing at right angles to the work insertion path can be a movement of a horizontal direction.

Furthermore, in the expanded tube processing method according to the present invention, the movement of the direction substantially crossing at right angles to the punch insertion path in the punch and/or the work may also be performed in at least two directions.

Moreover, in order to solve the aforementioned problems, according to a second aspect of the present invention, there is provided an expanded tube processing apparatus of a cylindrical tube, in which a punch is disposed on the side of an opening end of a work formed of the cylindrical tube of a metal and the punch is inserted from the opening end of the work to enlarge the diameter of an end of the work, the apparatus comprising: a forming die for holding the work in an inclined state with respect to a punch insertion path; driving means for moving the punch in a direction of the insertion path; and a support mechanism for supporting the punch and/or the work in a direction substantially crossing at right angles to the insertion path of the work in such a manner that floating is possible.

Furthermore, in the expanded tube processing apparatus according to the present invention, a work opening end surface on the side of insertion of the punch may also be formed to be substantially at right angles to the insertion path of the punch.

Additionally, in the expanded tube processing apparatus according to the present invention, the forming die for the work is formed to incline and hold the work with respect to a vertical direction, the insertion path of the punch is set in a vertical direction, and a floating direction of the punch and/or the work can also be set to a horizontal direction.

Moreover, in the expanded tube processing apparatus according to the present invention, the floating direction of the punch and/or the work may also be set to at least two directions.

Additionally, the expanded tube processing apparatus according to the present invention may also be provided with return means for returning the punch and/or the work to an original position side on which the tube expansion starts in the floating direction.

Moreover, in the expanded tube processing apparatus according to the present invention, the return means mentioned above may be urging means for constantly urging the punch and/or the work to the original position side.

Furthermore, in order to solve the aforementioned problems, according to a third aspect of the present invention, there is provided an expanded tube processing apparatus of a cylindrical tube, in which a punch is disposed on the side of an opening end of a work formed of the cylindrical tube of a metal and the punch is inserted from the opening end of the work to enlarge the diameter of an end of the work, the apparatus comprising: a forming die for fixing/holding the work in such a manner that an end of the work is inclined with respect to a punch insertion path; driving means for moving the work in a direction of the insertion path; and a support mechanism for supporting the punch in a direction substantially crossing at right angles to the insertion path of the work in such a manner that floating is possible.

MODE FOR CARRYING OUT THE INVENTION

Modes for carrying out the present invention will be described based on embodiments shown in FIGS. 1 to 17F.

FIGS. 1 to 5 show a first embodiment according to the present invention.

Figure 1:
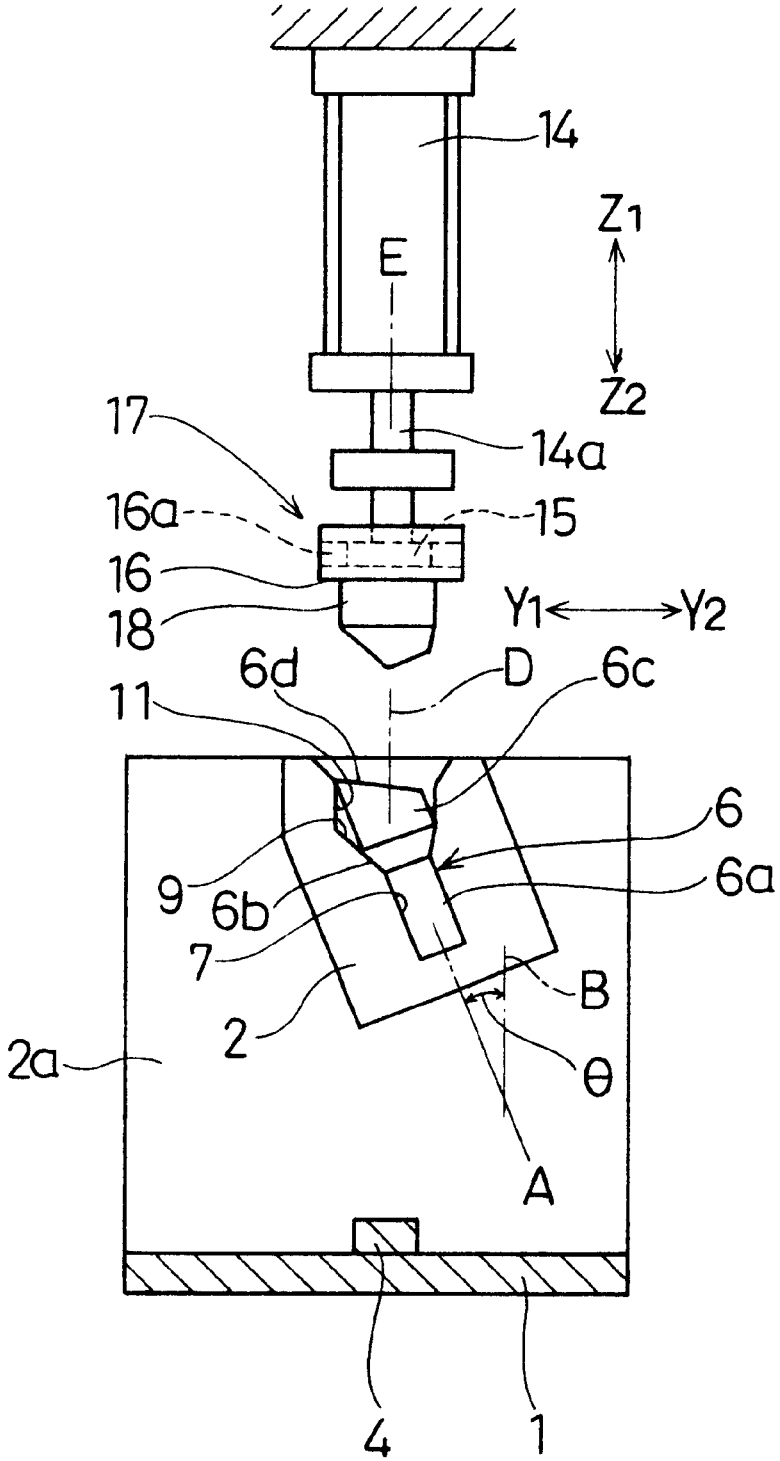
FIG. 1 shows a first embodiment according to the present invention, and is a front view seen from a side of a division surface of a fixed forming die.
Figure 2:
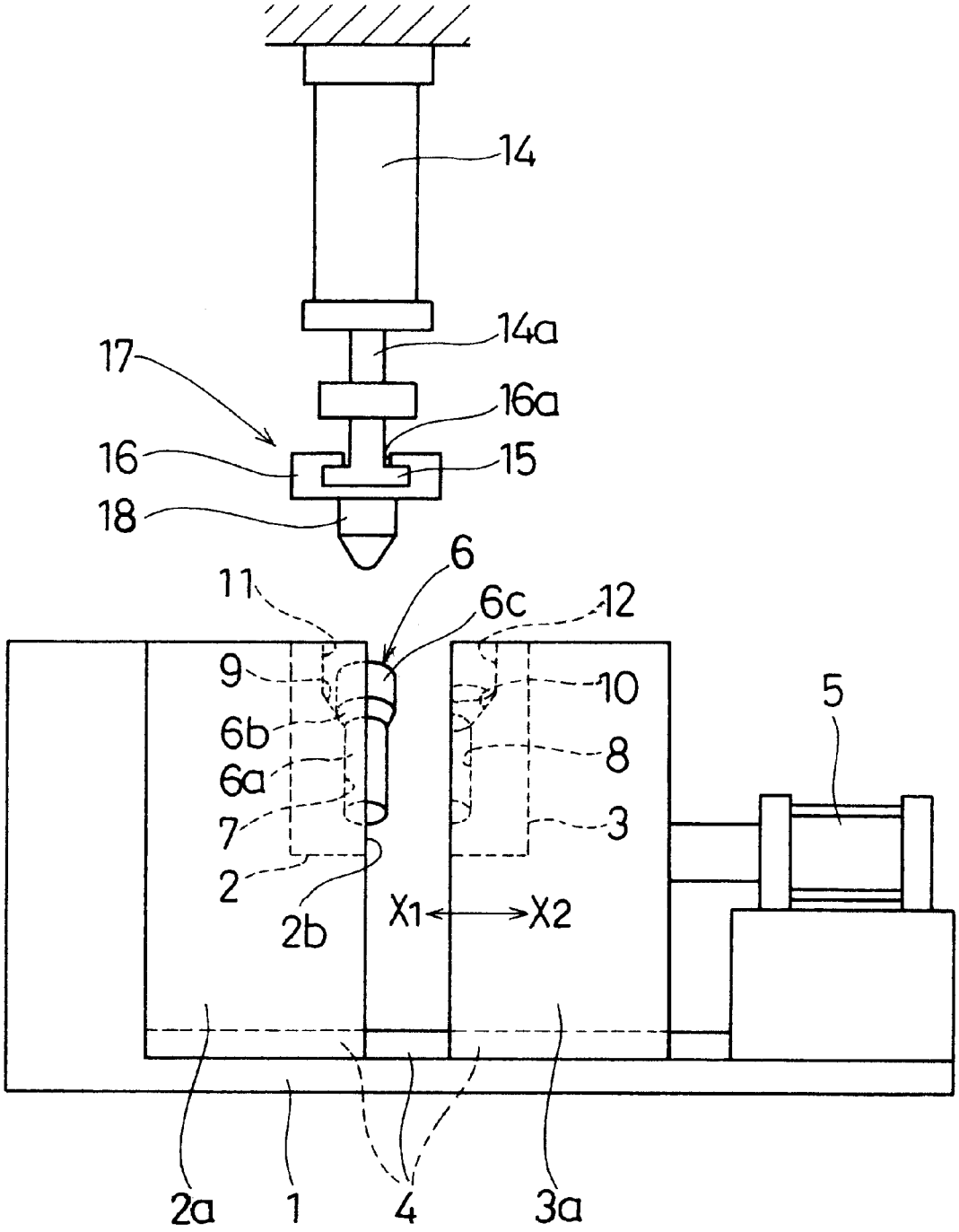
FIG. 2 is a side view of the first embodiment in FIG. 1.

In FIGS. 1 and 2, a rail 4 is disposed on a base 1 in a substantially horizontal direction (hereinafter referred to as $X_1$-$X_2$ direction), a die 2*a* is fixed on the base 1 on one end side of the rail 4, and on the rail 4 a movable die 3*a* is disposed along the rail 4, that is, opposite to the die 2*a* and movably in the $X_1$-$X_2$ direction. The movable die 3*a* is reciprocated/moved in the $X_1$-$X_2$ direction by a hydraulic cylinder 5 as driving means.

A fixed forming die 2 is fixed to an upper part in the die 2*a* on a side opposite to the movable die 3*a*, and a movable forming die 3 is fixed to the upper part in the movable die 3*a* on the side opposite to the die 2*a*.

In opposite surfaces of the fixed forming die 2 and movable forming die 3, holding grooves 7, 8 are formed, respectively, and engaged with a half surface in a peripheral direction of a rare tube portion 6*a* in a work 6 of a metal cylindrical tube. Furthermore, in upper parts of the holding grooves 7, 8, gradually changing processing die surfaces 9, 10 whose diameters increase from ends of the holding grooves 7, 8 in a tapered manner and enlarged diameter processing die surfaces 11, 12 positioned on upper ends of the gradually changing processing die surfaces 9, 10 are formed in semicircle sectional shapes.

Moreover, surfaces on a $Y_1$ direction side in the gradually changing processing die surfaces 9, 10 have a large inclination angle with respect to a vertical line as shown in the drawing, and surfaces on a $Y_2$ direction side have a small inclination angle with respect to the vertical line.

Figure 3:
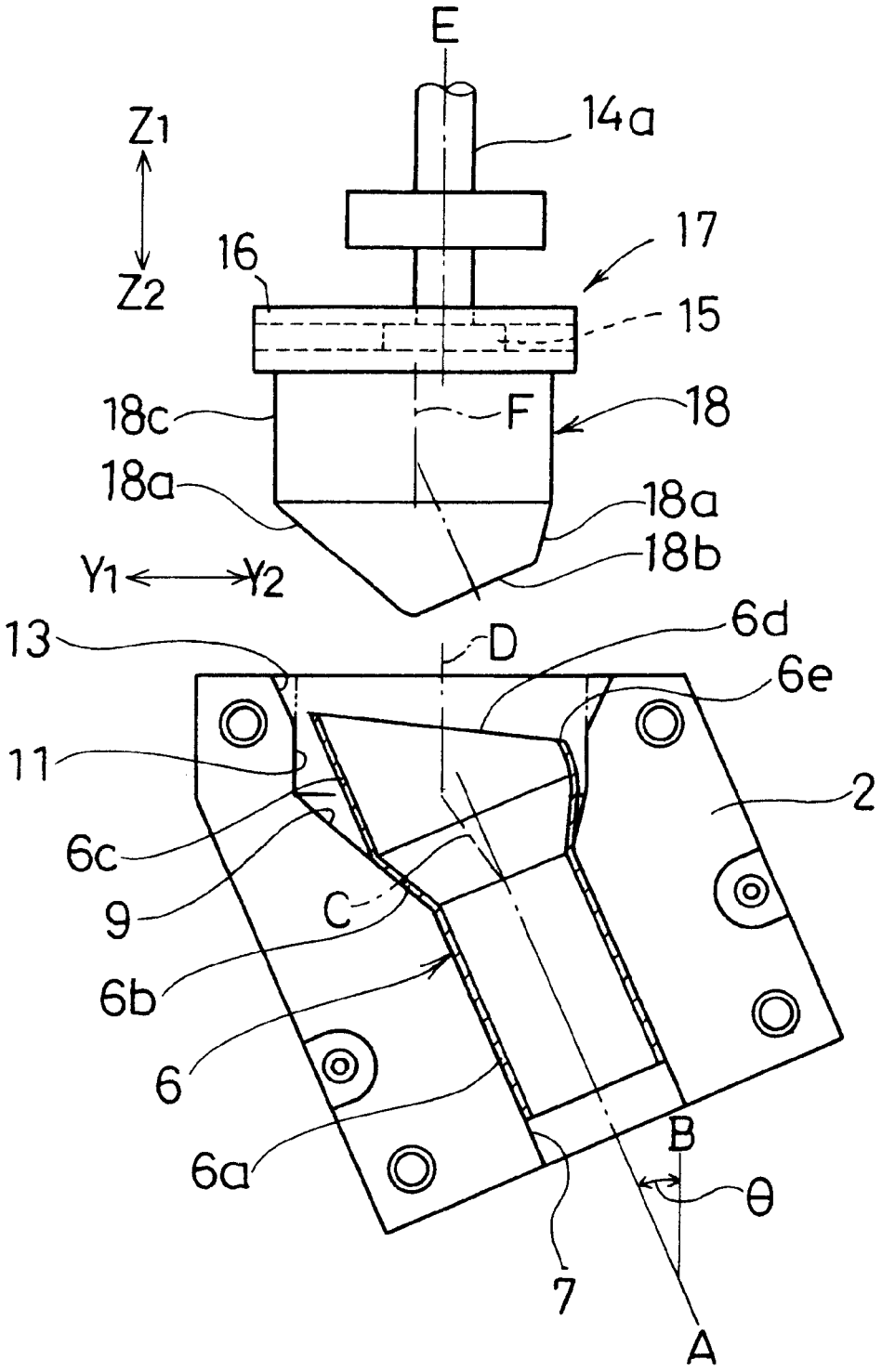
FIG. 3 is a main part front view of the first embodiment in FIG. 1.

The holding grooves 7, 8 are formed so that, as shown in FIGS. 1 and 3, an axis A thereof is inclined by a predetermined angle θ with respect to the vertical line B in a substantially horizontal direction (hereinafter referred to as $Y_1$-$Y_2$ direction) crossing at right angles to the $X_1$-$X_2$ direction. Moreover, the gradually changing processing die surfaces 9, 10 are formed so that, as shown in FIG. 3, an axis C thereof is inclined by a predetermined angle in the $Y_1$ direction with respect to the axis A of the holding grooves 7, 8. Furthermore, the enlarged diameter processing die surfaces 11, 12 are formed so that an axis D thereof is vertical as shown in FIG. 3. Additionally, upper ends of the enlarged diameter processing die surfaces 11, 12 are expanded with a taper surface 13 as shown in FIG. 3.

Moreover, FIG. 3 is a view of the fixed forming die 2 as seen from a division surface side, but the other movable forming die 3 is also formed similarly as the fixed forming die 2.

Above the fixed forming die 2, a hydraulic cylinder 14 as driving means is vertically disposed in an immobile state, and an axis E of a rod 14*a* is positioned on a division surface 2*b* of the fixed forming die 2 with respect to the $X_1$-$X_2$ direction, and is positioned in a center of the enlarged diameter processing die surface 11 with respect to the $Y_1$-$Y_2$ direction crossing at right angles to the $X_1$-$X_2$ direction as shown in FIGS. 1 and 3, that is, positioned along the axis D of the enlarged diameter processing die surface 11.

A lower end of the rod 13*a* is provided with a guide member 15 in a reverse T shape, so that a guide surface thereof is substantially horizontal in the $Y_1$-$Y_2$ direction. In the guide member 15, a rail-shaped punch support 16 provided with a reverse T shaped slot 16*a* formed in the $Y_1$-$Y_2$ direction and a punch 18 fixed to a lower surface thereof is disposed, so that the reverse T shaped slot 16*a* is slidably fitted in the guide member 15. Additionally, a floating support mechanism 17 constituted of the T slot structure allows the punch 18 to freely move in the $Y_1$-$Y_2$ direction, so that floating is possible.

When the rod 14*a* moves forward and backward by the hydraulic cylinder 14, the punch 18 is driven in a $Z_1$-$Z_2$ direction. The $Z_1$-$Z_2$ direction indicates an insertion path of the punch 18.

The punch 18 is, as shown in FIG. 3, provided with: a tapered die surface 18*a* corresponding to the gradually changing processing die surfaces 9, 10 in the fixed forming die 2, 3; a bottom surface 18*b* formed with a slope surface ascending in the $Y_2$ direction on a lower side of the die surface 18*a*; and a vertical die surface 18*c* corresponding to the enlarged diameter processing die surfaces 11, 12 in an upper part of the die surface 18*a*, and a lower portion of the punch 18 is formed in a tapered manner.

An expanded tube processing method will next be described.

First, before the processing by the punch 18, one end of the rare tube portion 6*a* of the work 6 to be processed is enlarged in diameter beforehand by dies or the like, and as shown in FIGS. 1 to 3, a gradually changing portion 6*b* and an enlarged diameter portion 6*c* coaxial with the axis A of the rare tube portion 6*a* are molded. Additionally, an opening end surface 6*d* of the enlarged diameter portion 6*c* is formed, as shown in FIG. 3, to incline it with respect to the axis A of the rare tube portion 6*a* in such a manner that the surface becomes substantially horizontal when the work 6 is set on the forming die. Specifically, the opening end surface is formed to be substantially at right angles to the insertion path $Z_1$-$Z_2$ of the punch 18.

Subsequently, as shown in FIG. 2, when the movable die 3*a* is moved backward and opened by the hydraulic cylinder 5 as the driving means, the work 6 is fitted into the fixed forming die 2 as shown in FIGS. 1 to 3. Specifically, the rare tube portion 6*a* is fitted into the holding groove 7, and the gradually changing portion 6*b* and enlarged diameter portion 6*c* are positioned in the gradually changing processing die surface 9 and enlarged diameter processing die surface 11. Subsequently, the hydraulic cylinder 5 is advanced to move the movable die 3*a* in a direction of an arrow $X_1$, the movable forming die 3 is brought into the fixed forming die 2, and the work 6 is clamped and held with both forming dies 2, 3.

Thereby, as shown in FIGS. 1 and 3, the work 6 is inclined by the predetermined angle θ with respect to the vertical line B in the $Y_1$-$Y_2$ direction, and the opening end surface 6*d* is disposed and fixed in the direction substantially crossing at right angles to the vertical direction (insertion path of the punch 18).

Subsequently, the punch 18 is manually moved in the $Y_1$-$Y_2$ direction, and as shown in FIG. 3, the punch 18 is positioned in such a manner that an axis F of the punch 18 is slightly displaced in the $Y_1$ direction from the axis D of the enlarged diameter processing mold surfaces 11, 12. Specifically, the punch is positioned in such a manner that the tapered bottom surface 18*b* of the punch 18 fails to interfere with an end 6*e* of the opening end surface 6*d* in the $Y_2$ direction. This is regarded as an original position.

Figure 4:
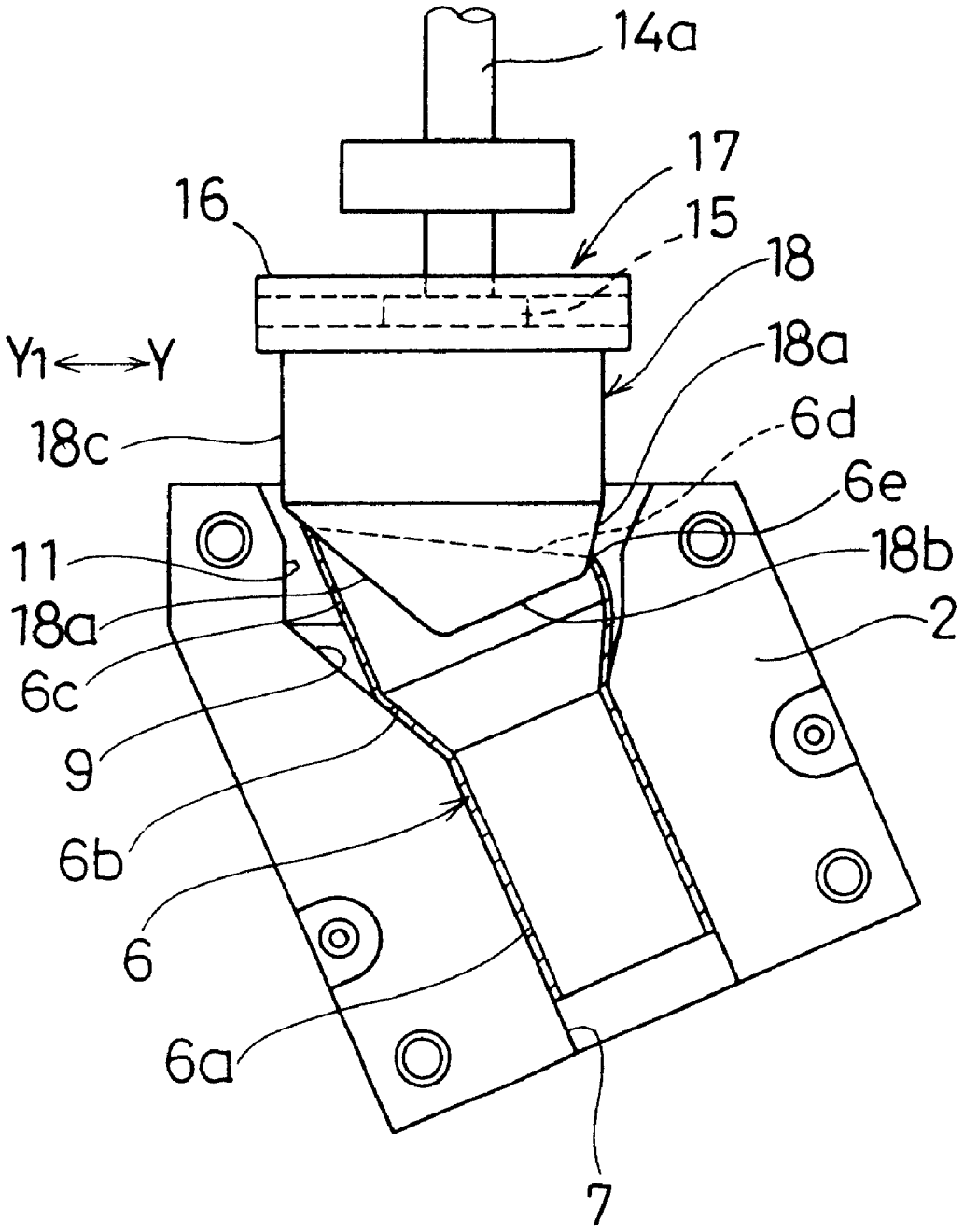
FIG. 4 is a main part front view showing a midway state in which a punch is inserted from a state shown in FIG. 3.

Subsequently, the hydraulic cylinder 14 as raising/lowering drive means is lowered, and the punch 18 is substantially vertically lowered in the $Z_2$ direction via the rod 14*a* and floating support mechanism 17. By the lowering, as shown in FIG. 4, the punch 18 first enters the enlarged diameter portion 6*c* of the work 6 without interfering with the end 6*e* of the opening end surface 6*d* of the work 6, and the end 6*e* abuts on the die surface 18*a* of the punch 18.

Moreover, since the opening end surface 6*d* of the work is formed in the direction substantially crossing at right angles to the advancing direction of the punch 18, that is, the opening end surface 6*d* is opened corresponding to the advancing direction of the punch 18, the punch 18 is easily inserted.

Subsequently, by further lowering the punch 18 from the state in FIG. 4, the enlarged diameter portion 6*c* of the work 6 is expanded by the die surface 18*a* provided with a small inclination angle to the vertical line. In this case, since the end 6*e* of the work 6 is expanded outwardly from the abutment state on the die surface 18*a* of the punch 18, tube expansion of the end 6*e* is satisfactorily performed.

Figure 5:
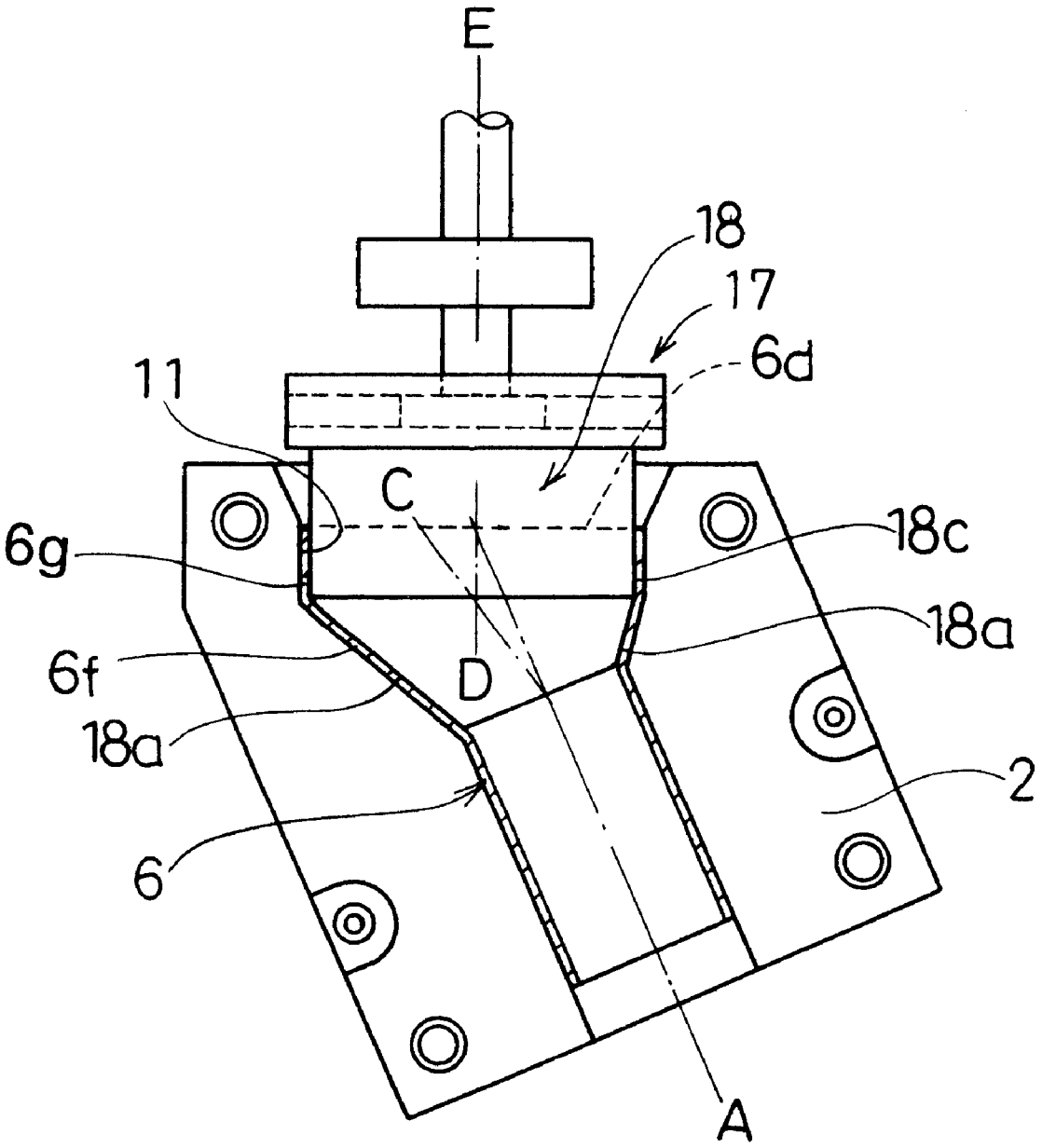
FIG. 5 is a main part front view showing an expanded tube state in which the punch is further inserted from the state shown in FIG. 4.

According to a tube expanding action by entrance of the punch 18, the punch 18 is restricted by the $Y_1$ side surface in the enlarged diameter processing die surfaces 11, 12 and a reaction (load) in the $Y_2$ direction acts. Therefore, the punch 18 is moved in the $Y_2$ direction by the floating support mechanism 17 from the original position in a driven manner and lowered to obtain a state in FIG. 5, the gradually changing portion 6*b* and enlarged diameter portion 6*c* of the work 6 are, as shown in FIG. 5, molded into a gradually changing portion 6*f* formed of the axis C inclined with respect to the rare tube portion 6*a* by the die surface 18*a* of the punch 18 and the gradually changing processing die surfaces 9, 10, and further molded into an expanded tube portion 6*g* provided with the vertical axis D by the vertical die surface 18*c* of the punch 18 and the enlarged diameter processing mold surfaces 11, 12, and the gradually changing portion 6*f* and expanded tube portion 6*g* are integrally molded in series.

After the molding, the punch 18 is raised and removed from the expanded tube portion 6*g* of the work 6 by raising the hydraulic cylinder 14, and the movable die 3*a* is moved backward by the hydraulic cylinder 5 to open both dies 2, 3 and extract the work 6.

Additionally, by enlarging the diameter of the expanded tube side of the work 6 before the expanded tube processing as in the first embodiment, a tube expansion operation is satisfactorily performed.

Figure 6:
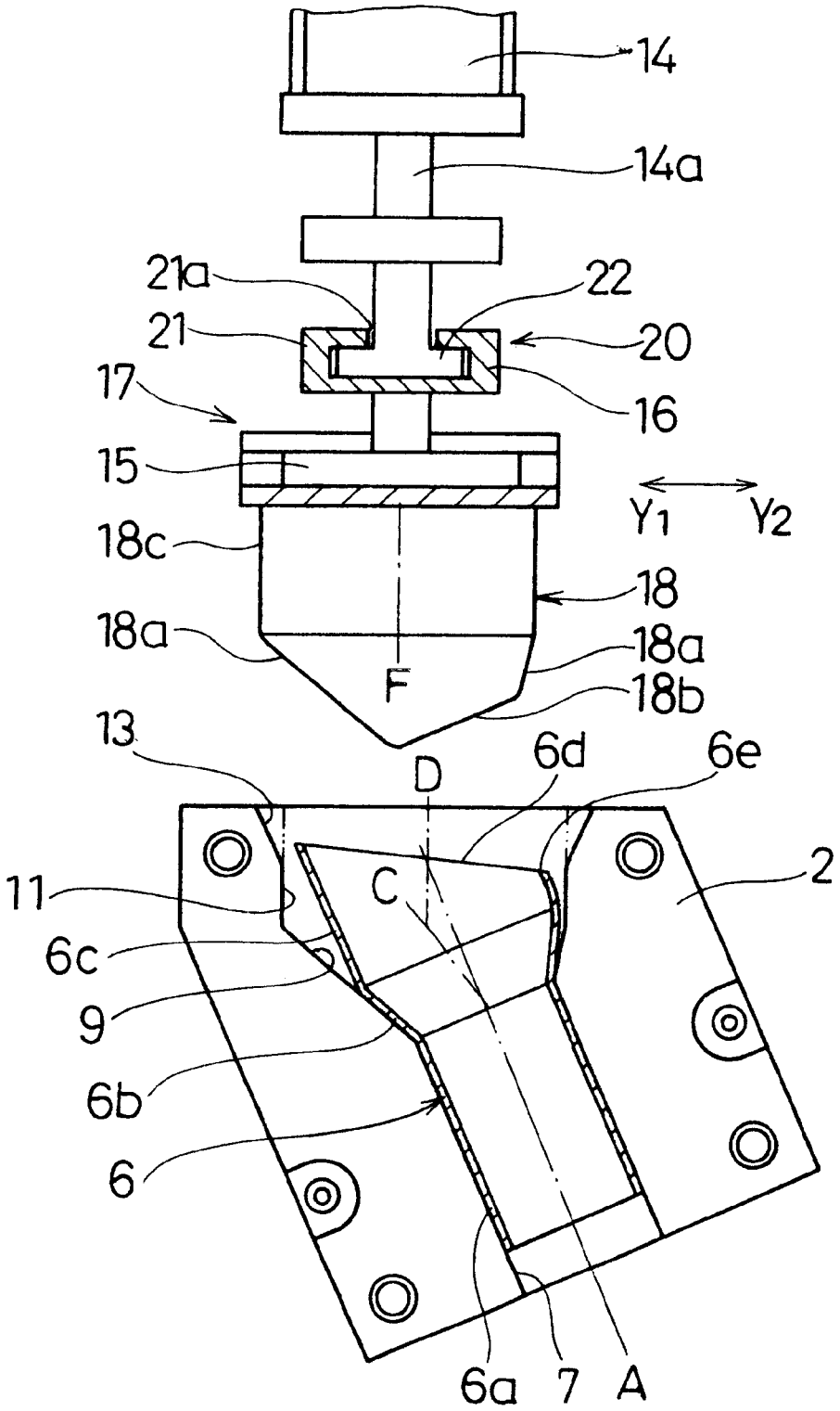
FIG. 6 shows a second embodiment according to the present invention, and is a partially cut front view seen from the side of the division surface of a fixed forming die.

FIG. 6 shows a second embodiment of the present invention.

In the second embodiment, in addition to the $Y_1$-$Y_2$ direction floating support mechanism 17 of the T slot structure in the aforementioned first embodiment, a second floating support mechanism 20 is further disposed in which the punch 18 can also freely move in the $X_1$-$X_2$ direction. Specifically, a rail 21 provided with a reverse T shaped slot 21*a* formed in the $X_1$-$X_2$ direction is fixed to the guide member 15 in the floating support mechanism 17 in the $Y_1$-$Y_2$ direction, a reverse T shaped guide member 22 provided with a guide surface of the $X_1$-$X_2$ direction is slidably fitted into the slot 21*a* of the rail 21, and the guide member 22 is fixed to the rod 14*a* of the hydraulic cylinder 14 as the raising/lowering drive means.

Since other structures are similar to those of the first embodiment, the same components are denoted with the same reference numerals as the aforementioned numerals and description thereof is omitted.

Also in the second embodiment, by lowering the punch 18 similarly as the first embodiment, the work 6 can be processed similarly as described above. Furthermore, in the second embodiment, since the floating support mechanism 20 to the $X_1$-$X_2$ direction is added separately from the floating support mechanism 17 to the $Y_1$-$Y_2$ direction, it is unnecessary to precisely match the movement direction of the $Y_1$-$Y_2$ direction of the punch 18, that is, the $Y_1$-$Y_2$ direction of the slot 16*a* and guide member 15 and the direction in which the axis A of the work 6 is inclined.

Specifically, in the case that the movement direction of the punch 18, $Y_1$-$Y_2$, and the inclination direction of the axis A of the work 6 disagree with one another, when the punch 18 moves in the $Y_2$ direction, the load to the $X_1$-$X_2$ direction is applied to the punch 18 to prevent the punch 18 from being inserted. However, by providing the floating support mechanism 20 to the $X_1$-$X_2$ direction as in the second embodiment, the punch 18 moves also in the $X_1$-$X_2$ direction in the driven manner, and the expanded tube processing can satisfactorily be performed without any difficulty.

Therefore, in the first embodiment, it is necessary to form the forming dies 2, 3 and floating support mechanism 17 with high precision with respect to the $Y_1$-$Y_2$ direction, while in the second embodiment this is unnecessary, and the apparatus can be simplified.

FIGS. 7 to 10 show a third embodiment according to the present invention.

Similarly as the second embodiment, the third embodiment shows another example in which two floating support mechanisms are disposed.

Figure 7:
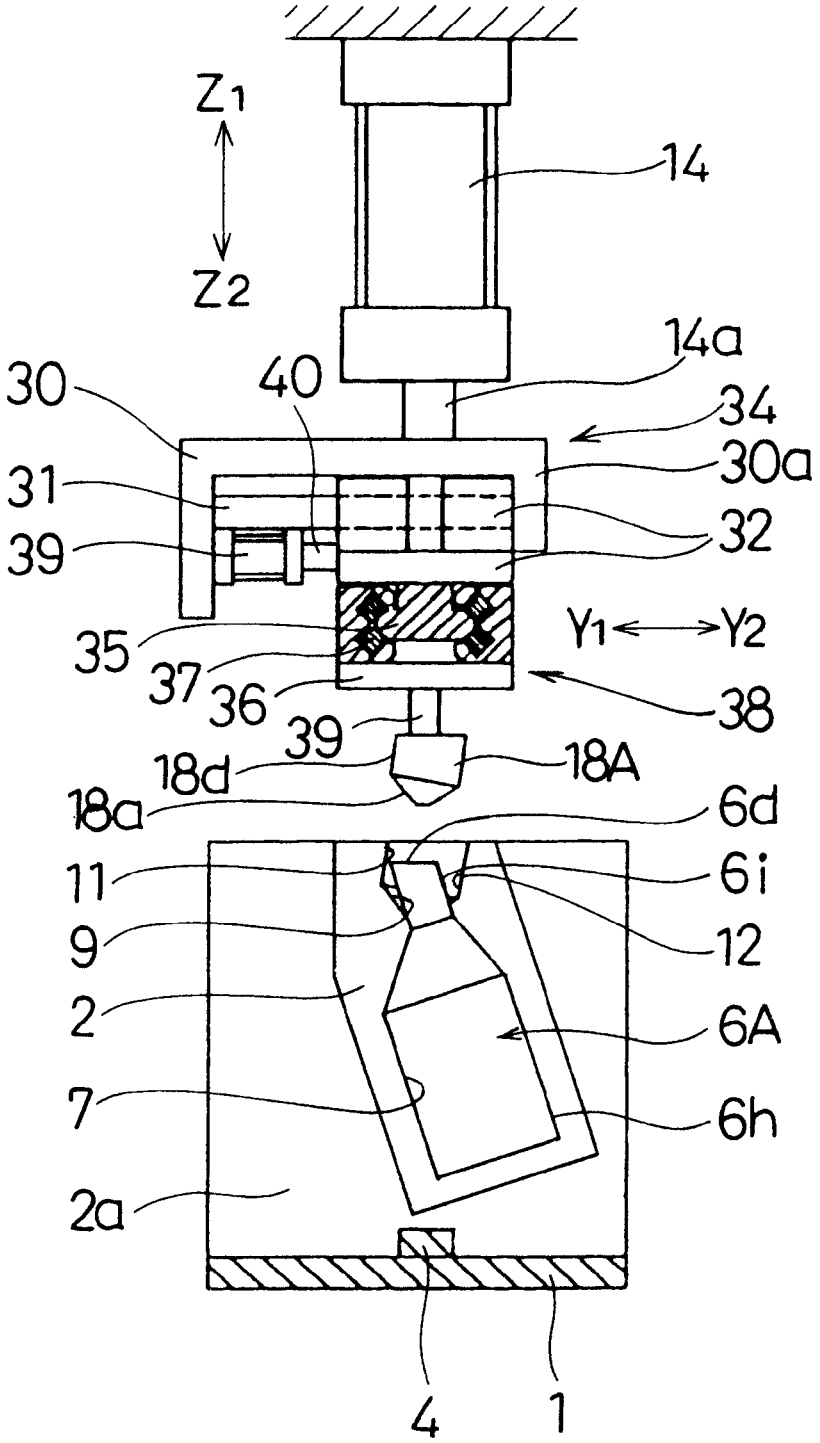
FIG. 7 shows a third embodiment according to the present invention, and is a partially cut front view seen from the division surface of a fixed forming die.
Figure 8:
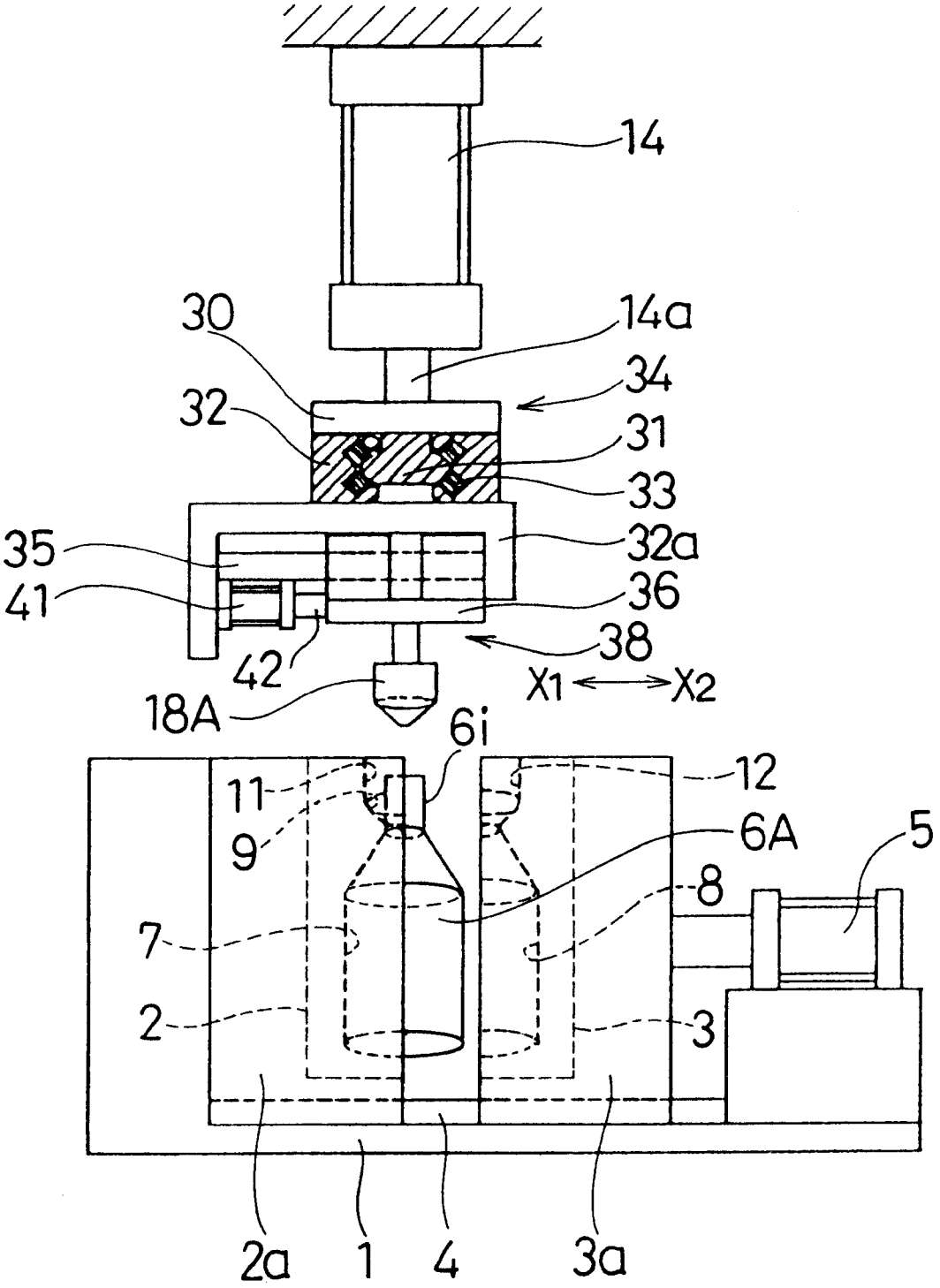
FIG. 8 is a side view of the third embodiment in FIG. 7, and is a partially cut view.

In FIGS. 7 and 8, the die 2*a* and movable die 3*a* are constituted similarly as the embodiment shown in FIGS. 1 and 2, the die 2*a* is provided with the fixed forming die 2, and the movable die 3*a* is provided with the movable forming die 3.

In the third embodiment, as the work before the expanded tube processing, as shown in the drawing, a work is used in which a reduced diameter portion 6*i* is molded on one end of a rare tube portion 6*h* beforehand by displacing an axis G (see FIG. 9) from the axis A of the rare tube portion 6*h* through spinning process or swaging process. Moreover, the opening end surface 6*d* of the reduced diameter portion 6*i* of a work 6A is formed to become substantially horizontal when the work 6A is set similarly as described above.

Figure 9:
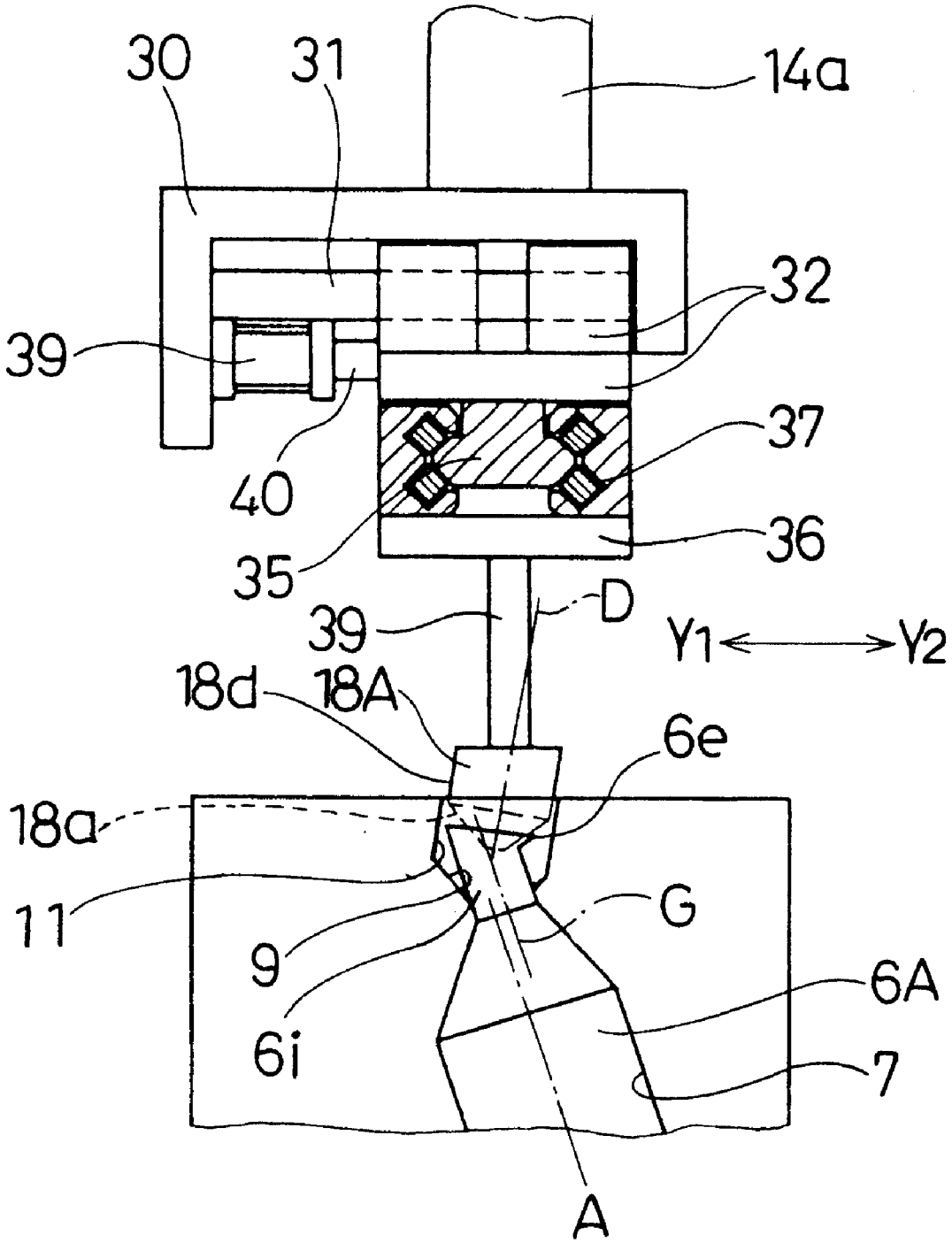
FIG. 9 is a main part front view of the third embodiment in FIG. 7 showing the insertion midway state of the punch.

Furthermore, the enlarged diameter processing die surfaces 11, 12 in the fixed forming die 2 and movable forming die 3 are formed in sloping surfaces whose axis D slopes in the $Y_1$-$Y_2$ direction with respect to the vertical direction as shown in FIG. 9.

Since other structures on the sides of the fixed forming die 2 and movable forming die 3 are similar to those of the first embodiment, the same components are denoted with the same reference numerals as the aforementioned numerals and description thereof is omitted.

Above the fixed forming die 2, the hydraulic cylinder 14 as the raising/lowering means is pendently disposed in the immobile state, and a first support frame 30 is fixed to the lower end of the rod 14*a*. On the lower portion of the first support frame 30 a linear rail 31 is disposed in the $Y_1$-$Y_2$ direction, the linear rail 31 is provided with a second support frame 32 by a bearing 33 in such a manner that the frame can freely move (float) in the $Y_1$-$Y_2$ direction, and these constitute a first floating support mechanism 34 in the $Y_1$-$Y_2$ direction.

On the lower portion of the second support frame 32 a linear rail 35 is disposed in the $X_1$-$X_2$ direction, the linear rail 35 is provided with a punch support 36 by a bearing 37 in such a manner that the support can freely move (float) in the $X_1$-$X_2$ direction, and these constitute a second floating support mechanism 38 in the $X_1$-$X_2$ direction. On the lower portion of the punch support 36 a rod 39 is pendently disposed, and a punch 18A is fixed to the lower end of the rod 39.

For the punch 18A, the axis is, as shown in FIG. 9, inclined and formed in the same direction ($Y_1$-$Y_2$ direction) as that of the axis D of the enlarged diameter processing die surfaces 11, 12 in the forming dies 2, 3, the lower part is provided with the tapered die surface 18*a* corresponding to the gradually changing processing die surfaces 9, 10 in the forming dies 2, 3, and the upper part is provided with the die surface 18*d* inclined in the $Y_1$-$Y_2$ direction corresponding to the enlarged diameter processing die surfaces 11, 12.

The air cylinder 39 constituting first original position return means is securely disposed to the first support frame 30 in the $Y_1$-$Y_2$ direction, a tip end of a rod 40 is fixed to the second support frame 32, the rod 40 is advanced by air supply into the air cylinder 39 until the second support frame 32 abuts on a corresponding piece 30*a* of the first support frame 30, and the punch 18A returns to the original position of the $Y_1$-$Y_2$ direction. Moreover, by freely supplying/discharging air in the air cylinder 39, movement of the second support frame 32 in the $Y_1$-$Y_2$ direction can freely be performed in the constitution.

Moreover, an air cylinder 41 constituting the second original position return means is securely disposed to the second support frame 32 in the $X_1$-$X_2$ direction, a tip end of a rod 42 is fixed to the punch support 36, the rod 42 is advanced by air supply into the air cylinder 41 until the punch support 36 abuts on a corresponding piece 32*a* of the second support frame 32, and the punch 18A returns to the original position of the $X_1$-$X_2$ direction. Moreover, by freely supplying/discharging air in the air cylinder 41, movement of the punch support 36 in the $X_1$-$X_2$ direction can freely be performed in the constitution.

Additionally, hydraulic cylinders may be used instead of the air cylinders 39, 41.

A processing method in the third embodiment will next be described.

First, the work 6A molded beforehand as shown in FIGS. 7 and 8 is held and fixed in an inclined state as shown in FIG. 7 by the fixed forming die 2 and movable forming die 3 similarly as the aforementioned embodiment.

Subsequently, air is supplied to the air cylinders 39 and 41 and the punch 18A is set in the original position as a processing start position with respect to the $Y_1$-$Y_2$ and $X_1$-$X_2$ directions.

After setting the original position in this manner, air is freely discharged/supplied with respect to both air cylinders 39, 41, so that the punch 18A can float in the $X_1$-$X_2$ and $Y_1$-$Y_2$ directions.

Subsequently the air cylinder 14 is lowered to lower the rod 14*a*. Thereby, the punch 18A is lowered in the vertical direction, and the tip end of the punch 18A is inserted into the reduced diameter portion 6*i* via the opening end surface 6*d* of the work 6A as shown in FIG. 9. In this case, the end 6*e* of the opening end surface 6*d* in the $Y_2$ direction is expanded to the outside from the inside by the tapered die surface 18*a* of the punch 18A. Therefore, the conventional interference fails to occur.

Figure 10:
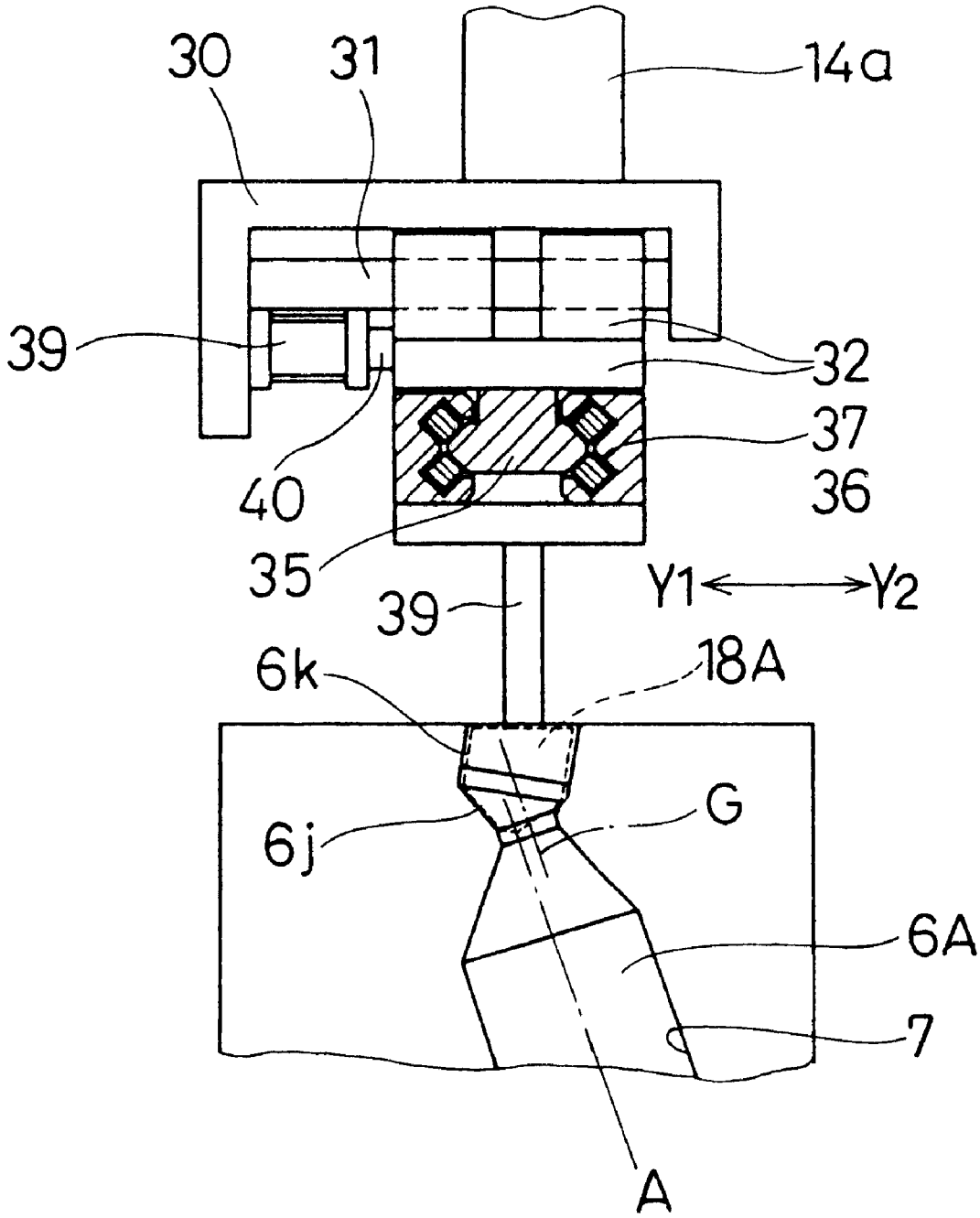
FIG. 10 is a main part front view showing the expanded tube state which the punch is inserted from the state shown in FIG. 9.

When the punch 18A is further lowered, the axis of the punch 18A and the axes of the enlarged diameter processing die surfaces 11, 12 are inclined with respect to the vertical direction as shown by D of FIG. 3, and a load for induction to the $Y_1$ direction therefore acts on the punch 18A. When this load acts, the second support frame 32 is driven in the $Y_1$ direction by the first floating support mechanism 34, and the punch 18A is driven in the $Y_1$ direction. Therefore, the punch 18A moves in the $Y_1$ direction to enter the reduced diameter portion 6*i*, and as shown in FIG. 10, by the punch 18A, gradually changing processing die surfaces 9, 10 and enlarged diameter processing die surfaces 11, 12, a gradually changing portion 6*j* displaced with respect to the axis A of the rare tube portion 6*h*, and an expanded tube portion 6*k* inclined with respect to the axis A of the rare tube portion 6*h* are integrally molded on one end of the rare tube portion 6*h*.

After the aforementioned expanded tube processing, when the punch 18A is moved upward by the air cylinder 14, by the first floating support mechanism 34 the punch 18A is raised and removed from the expanded tube portion 6*k* along a path reverse to the insertion path.

Therefore, as in the present embodiment, even when the axes of the punch 18A and enlarged diameter processing die surfaces 11, 12 are inclined with respect to the vertical direction, that is, even when the $Y_1$ direction side of the enlarged diameter processing die surfaces 11, 12 indicates a negative angle, the expanded tube processing can easily and securely be performed.

Furthermore, since the third embodiment is also provided with the floating support mechanism 38 in the $X_1$-$X_2$ direction, similarly as the second embodiment, during processing, the load of the $X_1$-$X_2$ direction acs on the punch 18A, then the punch 18A is driven in the load direction, and the apparatus can be simplified similarly as described above.

FIGS. 11 to 14 show a fourth embodiment according to the present invention.

In the fourth embodiment, the floating support mechanism is disposed on a forming die side.

Figure 11:
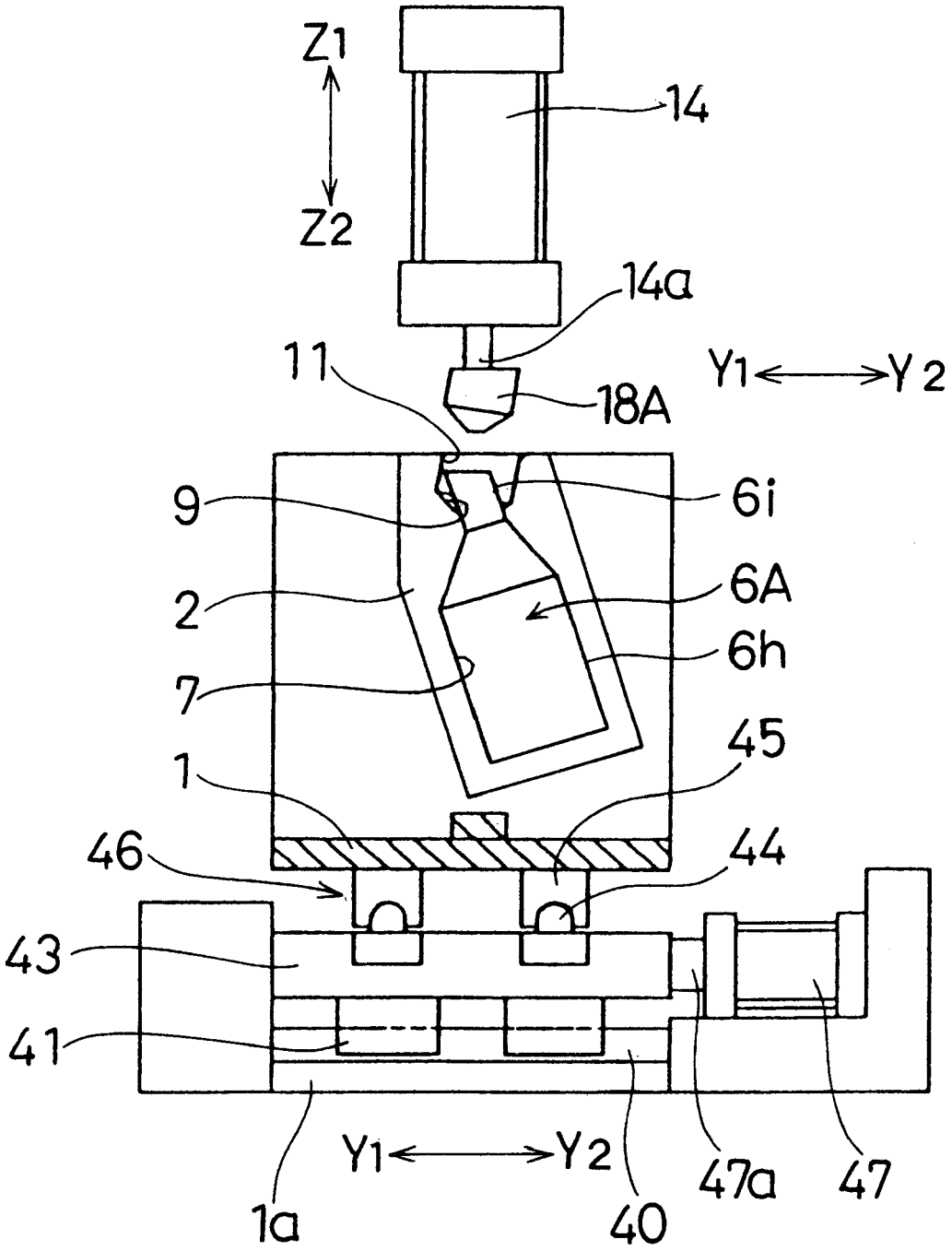
FIG. 11 shows a fourth embodiment according to the present invention, and is a partially cut front view seen from the side of the division surface of a fixed forming die.
Figure 12:
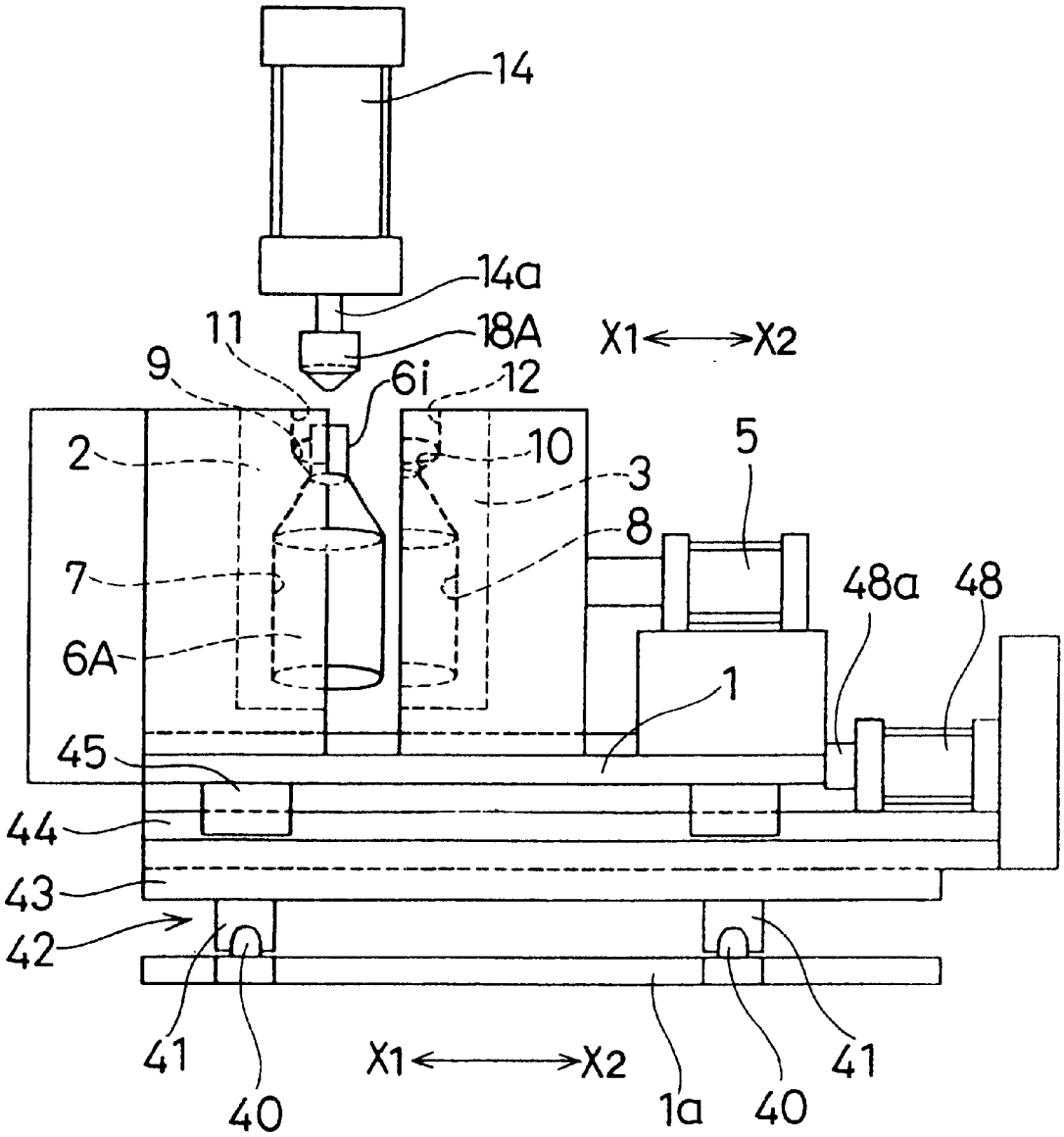
FIG. 12 is a side view of the fourth embodiment in FIG. 11.

In FIGS. 11 and 12, since the die 2*a*, movable die 3*a*, driving means 5, fixed forming die 2, movable forming die 3 and work 6A disposed on the base 1 are similar to those in the third embodiment, the same components are denoted by the same reference numerals as the aforementioned numerals and the description thereof is omitted.

On a base la disposed under the base 1, a linear rail 40 is disposed in the $Y_1$-$Y_2$ direction, a sliding member 41 is disposed to be movable in the $Y_1$-$Y_2$ direction on the linear rail 40, and these constitute a first floating support mechanism 42 of the $Y_1$-$Y_2$ direction. A support plate 43 is fixed onto the sliding member 41, a linear rail 44 is securely disposed onto the support plate 43 in the $X_1$-$X_2$ direction, and a sliding member 45 is disposed on the linear rail 44 to be movable in the $X_1$-$X_2$ direction. The linear rail 44 and sliding member 45 constitute a second floating support mechanism 46 of the $X_1$-$X_2$ direction. Moreover, the base 1 is fixed to the sliding member 45.

On the base 1*a*, an air cylinder 47 constituting first original position return means is securely disposed/fixed in the $Y_1$-$Y_2$ direction, a rod 47*a* thereof is fixed to the support plate 43, and by air supply into the air cylinder 39 the rod 47*a* advances to a predetermined position until both forming dies 2, 3 return to the original position of the $Y_1$-$Y_2$ direction.

Moreover, on the support plate 43, an air cylinder 48 constituting second original position return means is securely disposed in the $X_1$-$X_2$ direction, a rod 48*a* is fixed to the base 1, and by air supply into the air cylinder 48 the rod 48*a* advances to the predetermined position until both forming dies 2, 3 return to the original position of the $X_1$-$X_2$ direction.

Above the fixed forming die 2 in the original position the air cylinder 14 as raising/lowering drive means is securely disposed vertically, and the punch 18A is fixed to the lower end of the rod 14*a*. The punch 18A is formed similarly as the punch 18A of the third embodiment shown in FIGS. 7 to 10.

The processing method in the fourth embodiment will be described.

First, similarly as the aforementioned embodiment, by fitting the work 6A into the fixed forming die 2 and operating the air cylinder 5 to move the movable forming die 3 forward, the work 6A is held and fixed by both forming dies 2, 3.

Subsequently, air is supplied to the air cylinder 47 to set both forming dies 2, 3 in the original position of the $Y_1$-$Y_2$ direction while air is supplied to the air cylinder 48 to set both forming dies 2, 3 in the original position of the $X_1$-$X_2$ direction.

Subsequently, air of both air cylinders 47, 48 is freely discharged/supplied.

Figure 13:
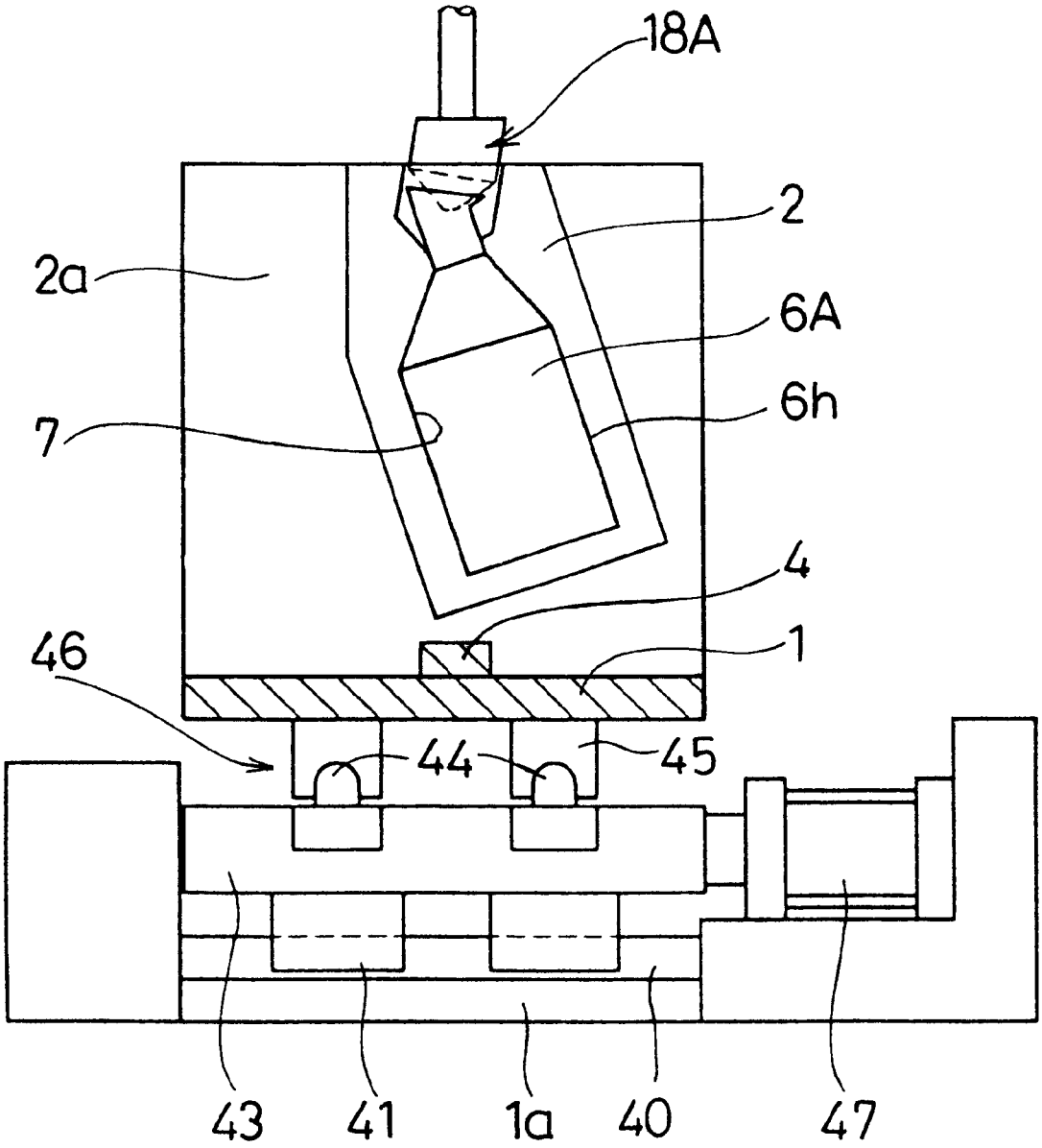
FIG. 13 is a main part front view of the fourth embodiment in FIG. 11 showing the insertion midway state of the punch.
Figure 14:
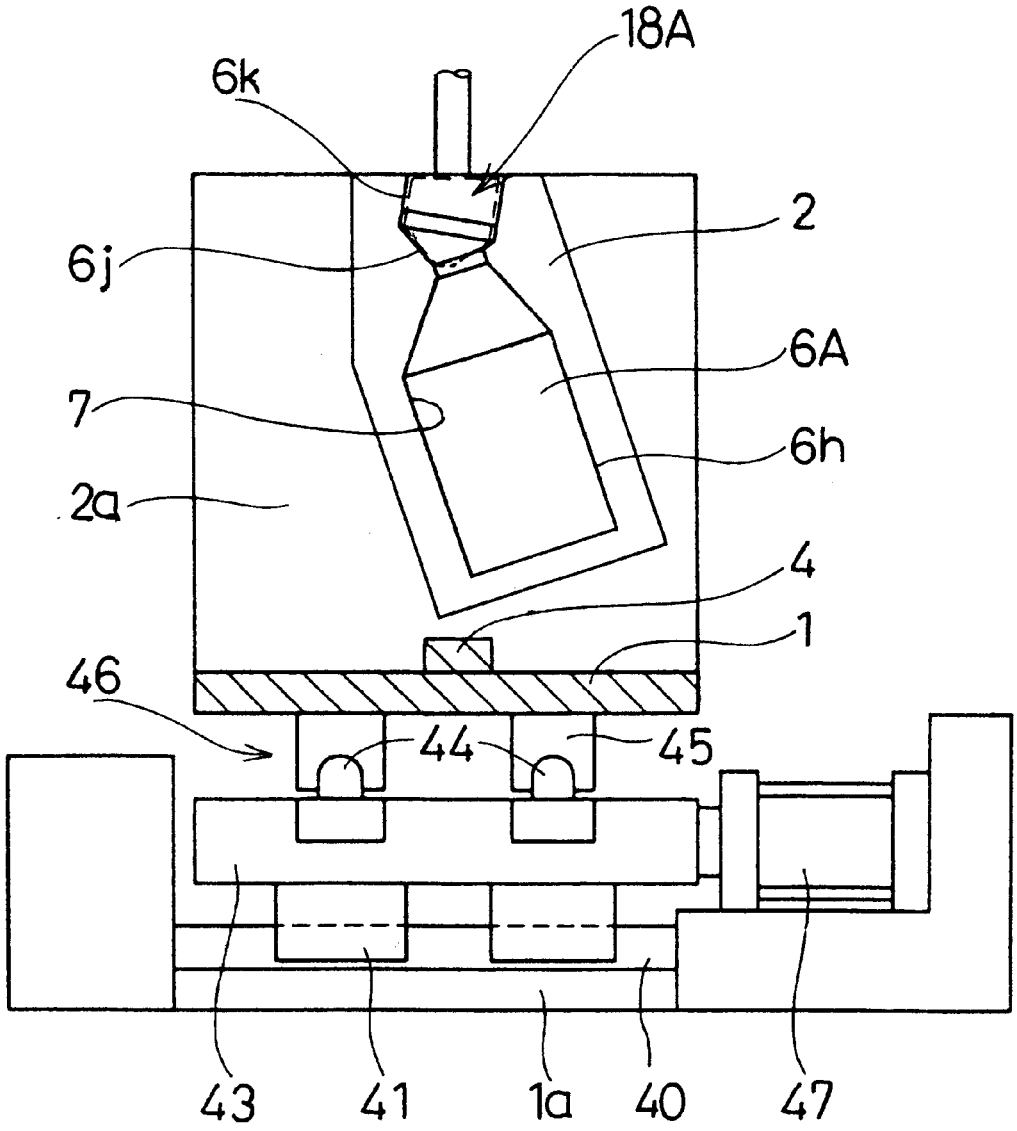
FIG. 14 is a main part front view showing the expanded tube state in which the punch is inserted from the state in FIG. 13.

Subsequently, the air cylinder 14 is lowered to lower the punch 18A in the vertical direction, and thus, the punch 18A is inserted via the opening of the educed diameter portion 6*i* of the work 6A as shown in FIG. 13. During the insertion, since the axis of the punch 18A and enlarged diameter processing die surfaces 11, 12 are inclined as described above, both forming dies 2, 3 are driven in the $Y_2$ direction. Therefore, both forming dies 2, 3 move in the $Y_2$ direction, the punch 18A is inserted and the reduced diameter portion 6*i* of the work 6A is molded into the gradually changing portion 6*j* and expanded tube portion 6*k* as shown in FIG. 14.

After the expanded tube processing, when the punch 18A is moved upward by the air cylinder 14, the second floating support mechanism 42 moves both forming dies 2, 3 in the $Y_1$ direction and the punch 18A is removed from the die along the path reverse to the insertion path.

Furthermore, since the fourth embodiment is also provided with the floating support mechanism 46 to the $X_1$-$X_2$ direction, during the processing by the punch 18A the load of the $X_1$-$X_2$ direction acts on both forming dies 2, 3, then both forming dies 2, 3 are driven in the load direction, and the apparatus can be simplified similarly as described above.

Figure 15:
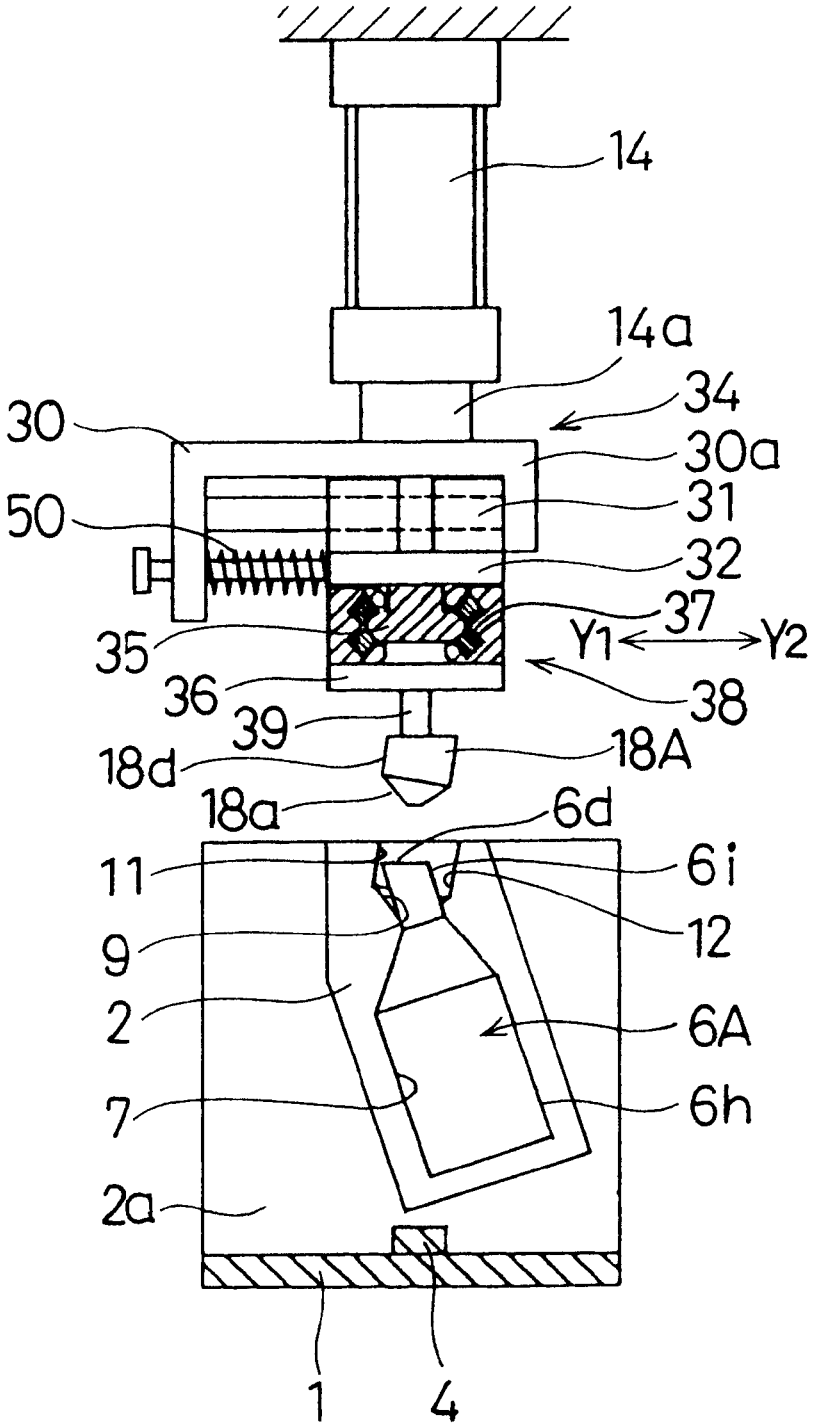
FIG. 15 shows a fifth embodiment according to the present invention, and is a partially cut front view seen from the side of the division surface of a fixed forming die.
Figure 16:
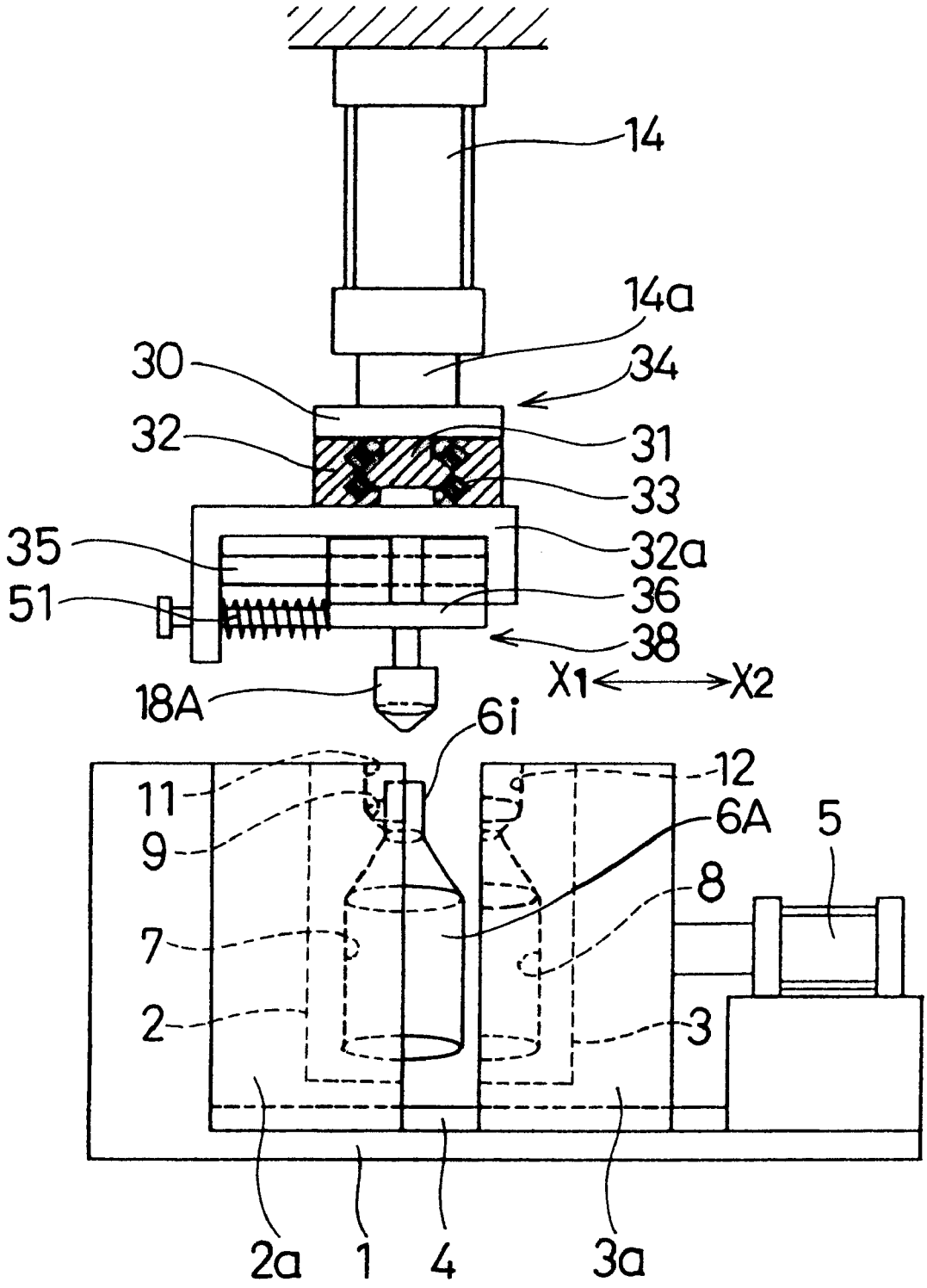
FIG. 16 is a side view of the fifth embodiment in FIG. 15.
Figure 17A:
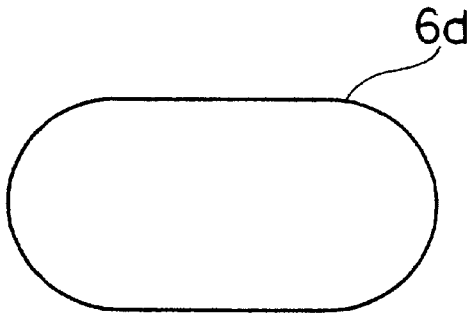
FIGS. 17A to 17F are diagrams showing examples of an expanded tube end surface subjected to tube expansion according to the present invention.
Figure 17C:
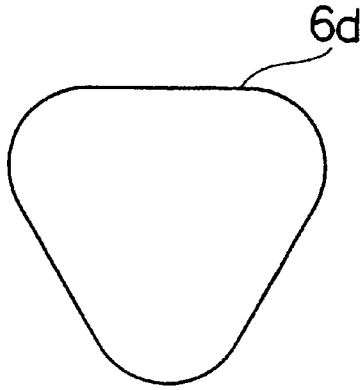
Figure 17B:
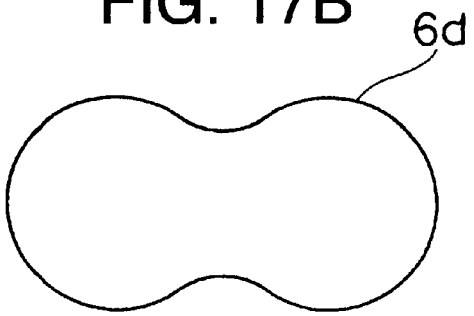
Figure 17D:
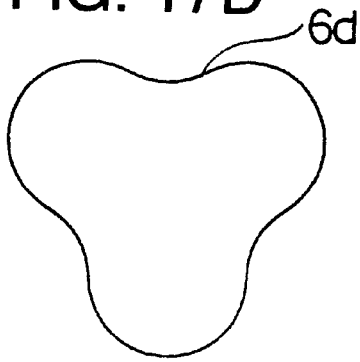
Figure 17E:
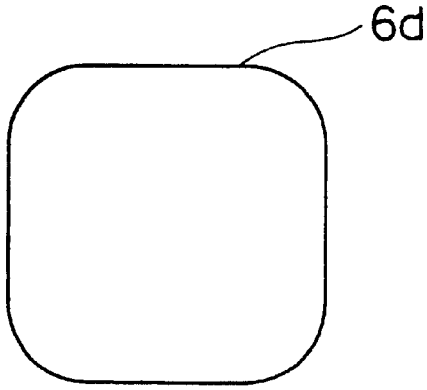
Figure 17F:
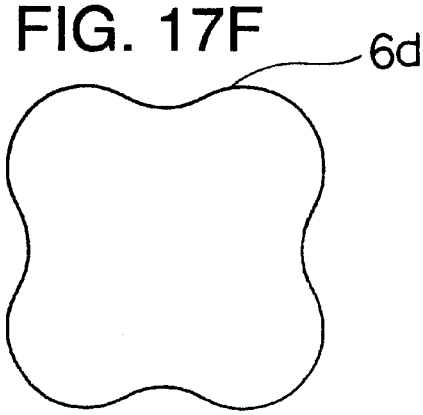
Figure 18:
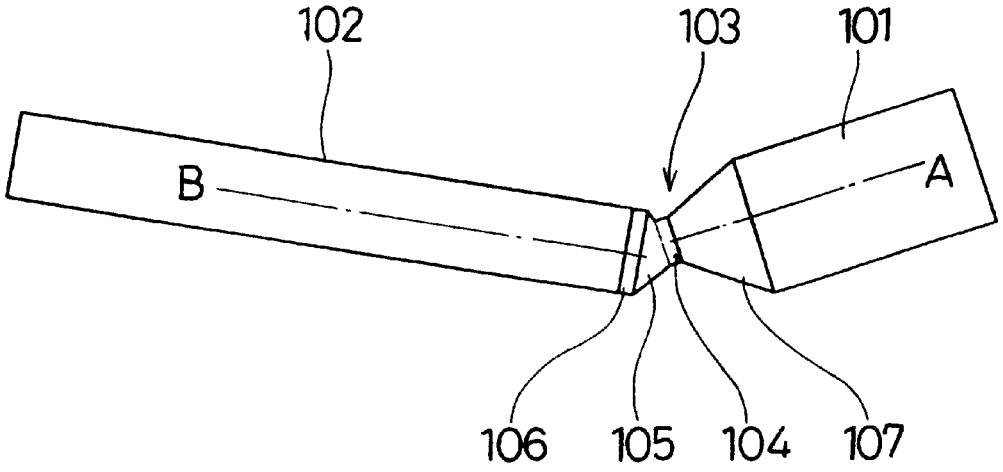
FIG. 18 is a diagram showing a use example of the cylindrical tube subjected to the tube expansion according to the present invention.
Figure 19:
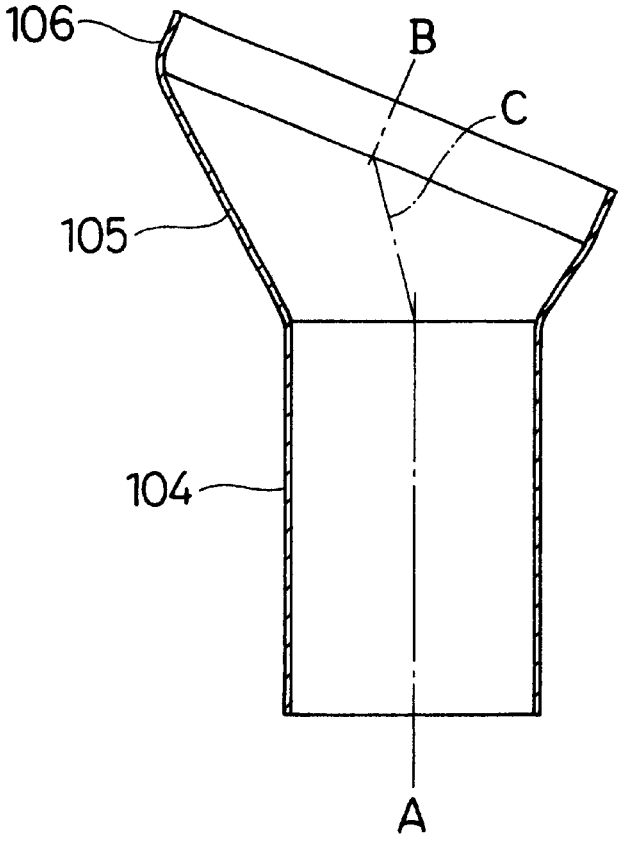
FIG. 19 is a sectional view showing an expanded tube portion to be molded according to the present invention.
Figure 20:
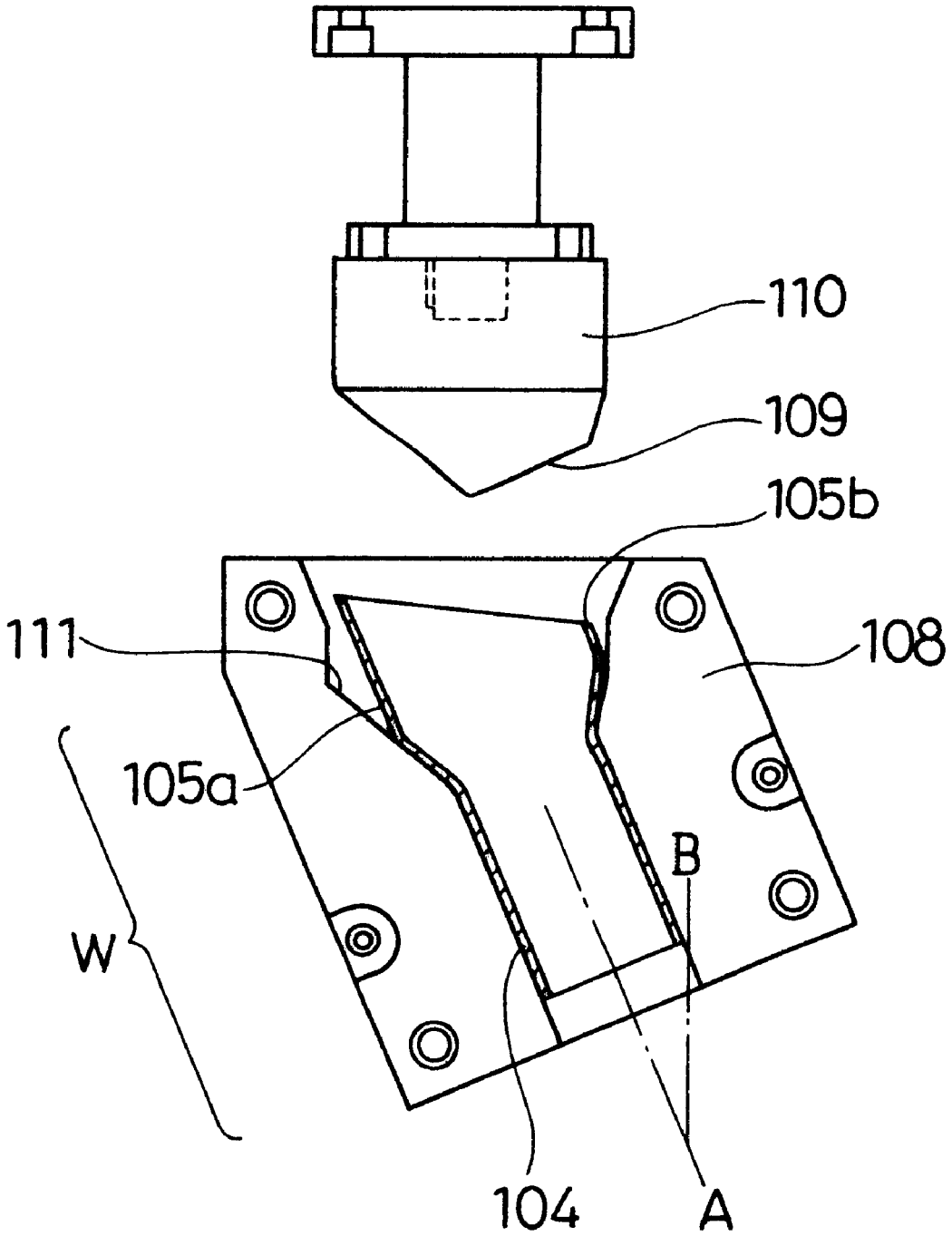
FIG. 20 is an explanatory view showing that a punch, developed by the present inventors in the process of inventing the method and apparatus of the present invention, is moved only in an insertion direction to perform the tube expansion.
Figure 21:
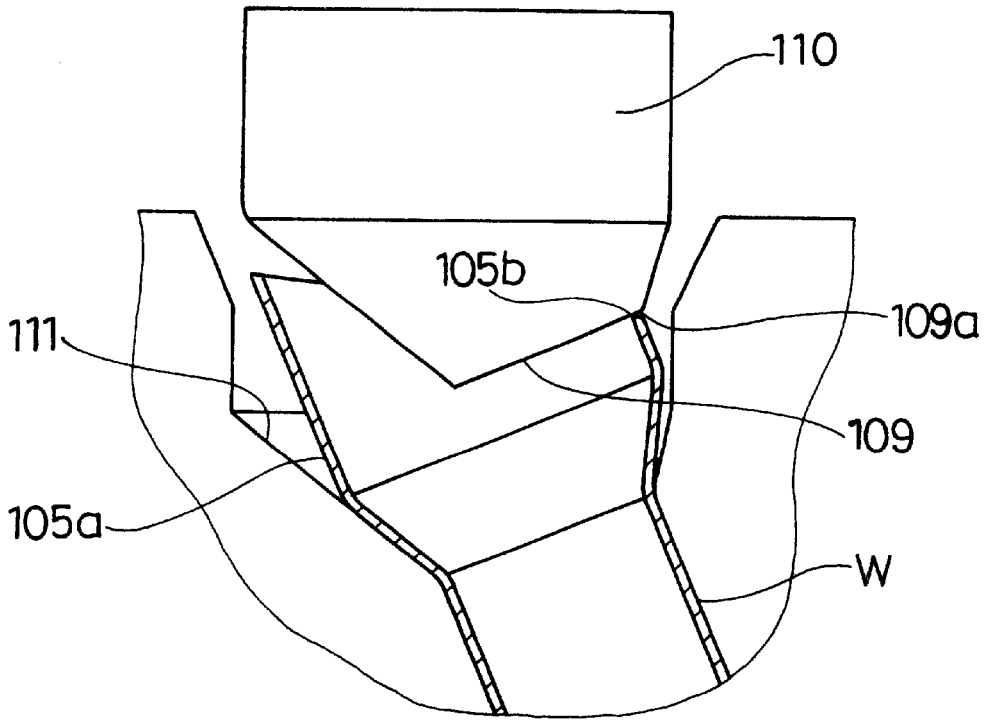
FIG. 21 is a diagram showing interference which occurs during the tube expansion in FIG. 20.

FIGS. 15 and 16 show a fifth embodiment.

In the fifth embodiment, the original position return means 39, 41 in the third embodiment shown in FIGS. 7 to 10 are formed by urging means for constant urging to the original position direction, and the drawings show an example in which a spring is used.

Specifically, a spring 50 for constantly urging the second support frame 32 in the $Y_2$ direction is interposed between the first support frame 30 and the second support frame 32 in FIGS. 7 and 8, and a spring 51 for constantly urging the punch support 36 in the $X_2$ direction is interposed between the second support frame 32 and the punch support 36.

Since other structures are similar to the structure shown in FIGS. 7 and 8, the same components as the aforementioned components are denoted with the same reference numerals and the description thereof is omitted.

Also in the fifth embodiment, action and effect similar to those of the third embodiment are fulfilled. Furthermore, in the present embodiment, during the processing by the punch 18A, when the punch 18A moves in the $Y_1$ direction, an urging force acts on the punch 18A in the direction ($Y_2$ direction) opposite to the movement direction, and deflection or the like of the punch 18A can be prevented, which contributes to a high processing precision.

Additionally, in the aforementioned embodiment, either one of the work side and the punch side is moved in a horizontal direction ($X_1$-$X_2$, $Y_1$-$Y_2$ direction), but both the work side and the punch side may be moved in the horizontal direction ($X_1$-$X_2$, $Y_1$-$Y_2$ direction).

Moreover, in the aforementioned embodiment, the work is disposed in such a manner that the opening end surface is turned upward, but when the work is disposed to turn the opening end surface sideways and the punch is inserted substantially horizontally from the sideways opening end surface, the $X_1$-$X_2$ and $Y_1$-$Y_2$ directions are set in a vertical plane.

Furthermore, the return means 47, 48 shown in FIGS. 11 to 14 may be constituted by urging means formed of the spring shown in FIGS. 15 and 16.

Additionally, transverse sections of the expanded tube portion and gradually changing portion of the work may be provided with irregular shapes such as elliptical, substantially triangle and substantially square shapes as shown in FIGS. 17A to 17F. In this case, the shapes of the punch and work forming die are formed in the shapes adapted to the aforementioned irregular shapes, and the work forming die is constituted in such a manner that the processed work can be extracted.

Effect of the Invention

As described above, according to the present invention, in an expanded tube processing method of a cylindrical tube, in which a punch is disposed on the side of an opening end of a work formed of the metal cylindrical tube and the punch is inserted from the opening end of the work to enlarge the diameter of an end of the work, by inserting the punch from the opening end of the work at a predetermined angle with respect to a tube axis of the work, and moving the punch and/or the work during insertion of the punch in a direction substantially crossing at right angles to the punch insertion path to perform an expanded tube processing, an expanded tube portion provided with an axis inclined with respect to the axis of the work can be formed. Additionally, by displacing the punch from the center position of the opening end of the work, inserting the punch into the work opening end without causing interference, and subsequently moving the punch in the direction substantially crossing at right angles to the insertion direction, the work opening end is pressed to the outside from the inside with the punch to eliminate the aforementioned conventional interference of the punch with the work opening end and the work can be subjected to the tube expansion.

Figure 22:
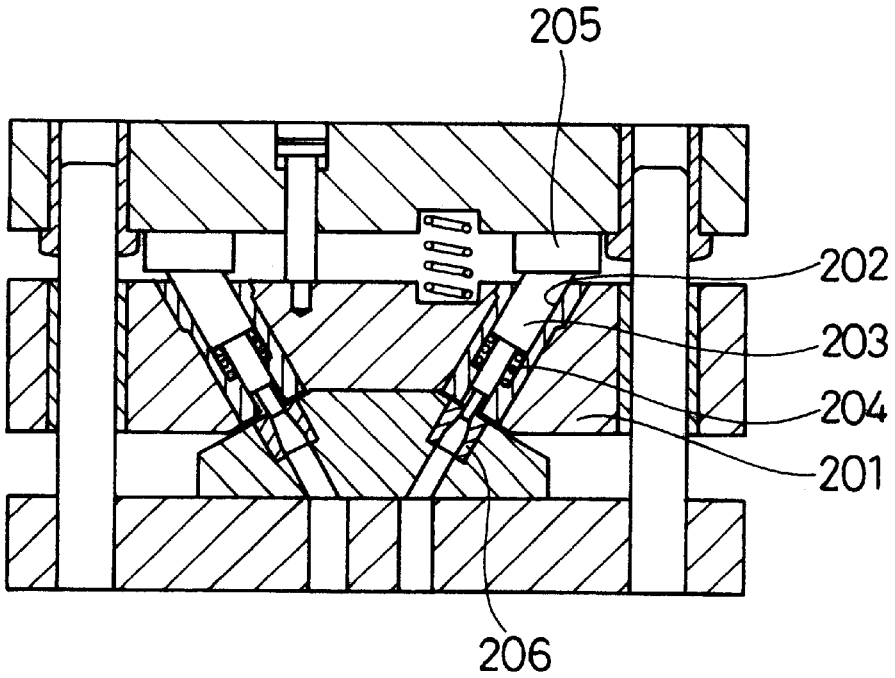
FIG. 22 is a sectional view showing a conventional punch structure.

Furthermore, without using the punch guide shown in FIG. 22, even the expanded tube portion different in inclination to the work axis can easily be handled. Therefore, the problem with the use of the punch guide can be solved. Furthermore, the gradually changing portion inclined with respect to the punch insertion path can easily be molded.

Moreover, according to the invention, in the expanded tube processing method, by forming the work opening end surface on the side of insertion of the punch to be substantially at right angles to the insertion path of the punch, the work opening end surface can be formed in the direction substantially crossing at right angles to the punch insertion path, the punch can easily be inserted, and the tube expansion can easily be performed.

Furthermore, according to the present invention, in the expanded tube processing method, the work is inclined and held with respect to the vertical direction, the insertion path of the punch is vertical, and movement of the punch and/or the work in the direction substantially crossing at right angles to the work insertion path is set to the movement of the horizontal direction. In this case, since the punch insertion path is vertical, general-purpose facilities (press machine, tube expander) can be used. Additionally, since the movement of the direction substantially crossing at right angles to the punch insertion path is the horizontal movement, as compared with the conventional movement along the inclined surface shown in FIG. 22, the punch smoothly moves, the movement in the specific direction by inclination fails to occur, and high-precision tube expansion is possible.

Additionally, according to the present invention, in the expanded tube processing method, since the movement in the direction substantially crossing at right angles to the punch insertion path in the punch and/or the work is performed in at least two directions, by moving the punch and/or the work in at least two directions, it is unnecessary to match the movement direction of the punch and/or the work with the inclination direction of the expanded tube portion, and arrangement of the facilities is simplified.

Moreover, according to the present invention, in the expanded tube processing apparatus of the cylindrical tube, in which the punch is disposed on the side of the opening end of the work formed of the metal cylindrical tube and the punch is inserted from the opening end of the work to enlarge the diameter of the end of the work, the apparatus comprises: a forming die for holding the work in an inclined state with respect to a punch insertion path; driving means for moving the punch in a direction of the insertion path; and a support mechanism for supporting the punch and/or the work in a direction substantially crossing at right angles to the insertion path of the work in such a manner that floating is possible, or further a work opening end surface on the side of insertion of the punch is formed to be substantially at right angles to the insertion path of the punch, so that the expanded tube processing method can be achieved.

Furthermore, since the punch and/or the work is constituted to move in the direction substantially crossing at right angles to the work insertion path, and is supported in a floating manner, the movement in the direction crossing at right angles to the work insertion path is naturally performed in a driven manner by the reaction acting on the punch and/or the work. Therefore, no moving drive means is necessary, and the tube expansion can satisfactorily be performed with a simple apparatus.

Additionally, according to the present invention, in the expanded tube processing apparatus, the forming die of the work is formed to incline and hold the work with respect to a vertical direction, the insertion path of the punch is set in a vertical direction, and a floating direction of the punch and/or the work is set to a horizontal direction, so that the expanded tube processing method can be achieved.

Moreover, according to the present invention, in the expanded tube processing apparatus, by setting the floating direction of the punch and/or the work to at least two directions, the expanded tube processing method can be achieved.

Furthermore, according to the present invention, in the expanded tube processing apparatus, by providing return means for returning the punch and/or the work to an original position side on which the tube expansion starts in the floating direction, after completion of the expanded tube processing the punch and/or the work is automatically returned to the original position in which the tube expansion starts, an operator's trouble for manual returning can be saved, and operation efficiency can be achieved.

Moreover, according to the present invention, in the expanded tube processing apparatus, when the return means comprises urging means for constant urging to the original position side, further the urging force constantly acts on the punch and/or the work in the direction opposite to the horizontal movement direction, the deflection or the like of the punch or the work can be prevented and the high precision of the tube expansion can be achieved.

Furthermore, according to the present invention, in the expanded tube processing apparatus of the cylindrical tube, in which the punch is disposed on the side of the opening end of the work formed of the metal cylindrical tube and the punch is inserted from the opening end of the work to enlarge the diameter of the end of the work, the apparatus comprises: a forming die for securely holding the work in such a manner that an end of the work is inclined with respect to a punch insertion path; driving means for moving the work in a direction of the insertion path; and a support mechanism for supporting the punch in a direction substantially crossing at right angles to the insertion path of the work in such a manner that floating is possible, the lightweight punch is moved rather than the work forming die, and therefore the movement structure can easily be constituted.

What is claimed is:

1. An expanded tube processing method of a cylindrical tube in which a punch is disposed on the side of an opening end of a work formed of the cylindrical tube of metal and the punch,is inserted from the opening end of the work to enlarge the diameter of an end of the work, said method comprising steps of: inserting the punch from the opening end of the work at a predetermined angle with respect to a tube axis of the work; and during insertion of the punch, moving the punch and/or the work in a direction substantially crossing at right angles to an insertion path of the punch to perform an expanded tube processing.

2. The expanded tube processing method according to claim 1, wherein a work opening end surface on the side of insertion of said punch is formed to be substantially at right angles to said insertion path of said punch.

3. The expanded tube processing method according to claim 2, wherein said work is inclined and held with respect to a vertical direction, said insertion path of said punch is vertical, and a movement of said punch and/or the work in the direction substantially crossing at right angles to the insertion path of said work is a movement of a horizontal direction.

4. The expanded tube processing method according to claim 3, wherein the movement of the direction substantially crossing at right angles to said punch insertion path in said punch and/or the work is performed in at least two directions.

5. The expanded tube processing method according to claim 2, wherein the movement of the direction substantially crossing at right angles to said punch insertion path in said punch and/or the work is performed in at least two directions.

6. The expanded tube processing method according to claim 1, wherein said work is inclined and held with respect to a vertical direction, said insertion path of said punch is vertical, and a movement of said punch and/or the work in the direction substantially crossing at right angles to the insertion path of said work is a movement of a horizontal direction.

7. The expanded tube processing method according to claim 6, wherein the movement of the direction substantially crossing at right angles to said punch insertion path in said punch and/or the work is performed in at least two directions.

8. The expanded tube processing method according to claim 1, wherein the movement of the direction substantially crossing at right angles to said punch insertion path in said punch and/or the work is performed in at least two directions.

9. An expanded tube processing apparatus of a cylindrical tube, in which a punch is disposed on the side of an opening end of a work formed of the cylindrical tube of metal and the punch is inserted from the opening end of the work to enlarge the diameter of an end of the work, the apparatus comprising: a forming die for holding the work in an inclined state with respect to an insertion path of the punch; driving means for moving the punch in a direction of said insertion path; and a support mechanism for supporting the punch and/or the work in a direction substantially crossing at right angles to said insertion path of the work in such a manner that floating is possible.

10. The expanded tube processing apparatus according to claim 9, wherein a work opening end surface on the side of insertion of said punch is formed to be substantially at right angles to the insertion path of said punch.

11. The expanded tube processing apparatus according to claim 10, wherein the forming die of said work is formed to incline and hold the work with respect to a vertical direction, the insertion path of said punch is set in a vertical direction, and a floating direction of said punch and/or the work is set to a horizontal direction.

12. The expanded tube processing apparatus according to claim 11, wherein the floating direction of said punch and/or the work is set to at least two directions.

13. The expanded tube processing apparatus according to claim 12, further comprising return means for returning said punch and/or the work to an original position side on which tube expansion starts in the floating direction.

14. The expanded tube processing apparatus according to claim 13, wherein said return means comprises urging means for constant urging to said original position side.

15. The expanded tube processing apparatus according to claim 11, further comprising return means for returning said punch and/or the work to an original position side on which tube expansion starts in the floating direction.

16. The expanded tube processing apparatus according to claim 15, wherein said return means comprises urging means for constant urging to said original position side.

17. The expanded tube processing apparatus according to claim 10, wherein the floating direction of said punch and/or the work is set to at least two directions.

18. The expanded tube processing apparatus according to claim 17, further comprising return means for returning said punch and/or the work to an original position side on which tube expansion starts in the floating direction.

19. The expanded/tube processing apparatus according to claim 18, wherein said return means comprises urging means for constant urging to said original position side.

20. The expanded tube processing apparatus according to claim 10, further comprising return means for returning said punch and/or the work to an original position side on which tube expansion starts in the floating direction.

21. The expanded tube processing apparatus according to claim 20, wherein said return means comprises urging means for constant urging to said original position side.

22. The expanded tube processing apparatus according to claim 9 wherein the forming die of said work is formed to incline and hold the work with respect to a vertical direction, the insertion path of said punch is set in a vertical direction, and a floating direction of said punch and/or the work is set to a horizontal direction.

23. The expanded tube processing apparatus according to claim 22, wherein the floating direction of said punch and/or the work is set to at least two directions.

24. The expanded tube processing apparatus according to claim 23, further comprising return means for returning said punch and/or the work to an original position side on which tube expansion starts in the floating direction.

25. The expanded tube processing apparatus according to claim 24, wherein said return means comprises urging means for constant urging to said original position side.

26. The expanded tube processing apparatus according to claim 9, wherein the floating direction of said punch and/or the work is set to at least two directions.

27. The expanded tube processing apparatus according to claim 26, further comprising return means for returning said punch and/or the work to an original position side on which tube expansion starts in the floating direction.

28. The expanded tube processing apparatus according to claim 27, wherein said return means comprises urging means for constant urging to said original position side.

29. The expanded tube processing apparatus according to claim 22, further comprising return means for returning said punch and/or the work to an original position side on which tube expansion starts in the floating direction.

30. The expanded tube processing apparatus according to claim 29, wherein said return means comprises urging means for constant urging to said original position side.

31. The expanded tube processing apparatus according to claim 9, further comprising return means for returning said punch and/or the work to an original position side on which tube expansion starts in the floating direction.

32. The expanded tube processing apparatus according to claim 31, wherein said return means comprises urging means for constant urging to said original position side.

33. An expanded tube processing apparatus of a cylindrical tube, in which a punch is disposed on the side of an opening end of a work formed of the cylindrical tube of metal and the punch is inserted from the opening end of the work to enlarge the diameter of an end of the work, the apparatus comprising: a forming die for securely holding the work in such a manner that an end of the work is inclined with respect to an insertion path of the,punch; driving means for moving the work in a direction of said insertion path; and a support mechanism for supporting the punch in a direction substantially crossing at right angles to said insertion path of the work in such a manner that floating is possible.

* * * * *